US007549364B2

(12) United States Patent
Koskela

(10) Patent No.: US 7,549,364 B2
(45) Date of Patent: Jun. 23, 2009

(54) SHELL LOADING SYSTEM

(76) Inventor: Richard A. Koskela, 11995 N. 139th Pl., Phoenix, AZ (US) 85259

( * ) Notice: Subject to any disclaimer, the term of this patent is extended or adjusted under 35 U.S.C. 154(b) by 270 days.

(21) Appl. No.: 11/511,711

(22) Filed: Aug. 29, 2006

(65) Prior Publication Data

US 2008/0053296 A1 Mar. 6, 2008

(51) Int. Cl.
*F42B 33/02* (2006.01)

(52) U.S. Cl. ..... 86/45; 86/25; 86/43

(58) Field of Classification Search ..... 86/45, 86/43, 25, 28

See application file for complete search history.

(56) References Cited

U.S. PATENT DOCUMENTS 2,824,484 A * 2/1958 Thompson ..... 86/45
3,602,084 A 8/1971 Corcoran
4,475,435 A * 10/1984 Mantel ..... 86/26
5,179,243 A * 1/1993 Schroeder ..... 86/25
2002/0121184 A1* 9/2002 Fowler ..... 86/45

* cited by examiner

*Primary Examiner*—Stephen M Johnson
(74) *Attorney, Agent, or Firm*—Parsons & Goltry; Michael W. Goltry; Robert A. Parsons

(57) ABSTRACT

Bullet feeder apparatus includes a fixture bounding a bullet-conducting passage therethrough, and a gate mounted to the fixture for movement between a closed position closing the bullet-conducting passage preventing a bullet from passing therethrough, and an open position opening the bullet-conducting passage allowing the bullet to pass therethrough into an open end of a shell. A bias applied to the gate biases the gate into the closed position. A deflector is mounted proximate the fixture for movement between a first position whereby the deflector is disposed away from the gate and the bias applied to the gate biases the gate in the closed position thereof closing the bullet-conducting passage, and a second position whereby the deflector is disposed toward and against the gate overcoming the bias applied thereto deflecting the gate from the closed position thereof to the open position thereof opening the bullet-conducting passage.

12 Claims, 14 Drawing Sheets

234
230
231
232
233
236
235
237
238
21
31
61
30
68
250
240
73
72
70
101
100
102
71
32
46

SHELL LOADING SYSTEM

FIELD OF THE INVENTION

The present invention relates to apparatus and methods for fabricating ammunition and, more particularly, to apparatus and methods for loading bullet shells with bullets.

BACKGROUND OF THE INVENTION

Ammunition consists of the projectiles and propelling charges used in small arms, artillery, and other guns. Ammunition size is usually expressed in terms of caliber, which is the diameter of the projectile as measured in millimeters or inches. In general, projectiles less than 20 mm or 0.60 inch in diameter are classified as small-arm, and larger calibers are considered artillery. A complete round of ammunition, which is referred to as a fixed type round, consists of all the components necessary for one firing of the gun. These normally included a projectile, the propellant, and a primer that ignites the propellant. Other components such as the cartridge case, fuze, and bursting charge are frequently included.

Small-arms ammunition is always of the fixed type. Complete rounds are usually called cartridges, and projectiles are called bullets. Cartridge cases or shells are most commonly made of brass, although steel is also widely used.

Handloading is the process used to create firearm cartridges by hand versus those put together en masse and sold commercially, generally in packages of 6 to 50. When previously-fired cases or shells are used, the process is often called reloading. The most common motivations for handloading cartridges are increased accuracy and cost savings, though handloaders may sacrifice one for the other. Reloading fired cases can save the shooter a significant amount of money, as the case is usually the major cost of a cartridge. The handloader can also create cartridges for which there are no commercial equivalents, such as wildcat cartridges. Collectors of obsolete firearms often have to handload since many obsolete cartridges are no longer commercially produced. Hunters may desire cartridges with specialized bullets. Target shooters seek optimum accuracy. Many handloaders customize their cartridges to their specific gun. This is usually in the pursuit of accuracy, though it can also lead to an increase in case life. For these specialty applications, cost is usually not a primary motivator, and such cartridges may cost more than commercial ones. As with any hobby, the pure enjoyment of the reloading process may well be the most important benefit.

There are three aspects to ballistics: internal ballistics, external ballistics, and terminal ballistics. Internal ballistics refers to the things which happen inside the weapon, before the bullet leaves the bore on firing. The handloading process can realize increased accuracy and precision through improved consistency of manufacture, and by customizing the weight and shape of the bullet, and tailoring the velocity of the bullet for best performance. Each cartridge loaded can have each component carefully matched to the rest of the cartridges in the batch. Brass cases can also be matched by volume and weight, bullets by weight and concentricity, powder charges by weight. Primers also play a role in accuracy and consistency, but the handloader usually has no ability to manufacture these, so the handloader is limited to experimenting with different primers available commercially. In addition to these items that are considered critical, the equipment used to assemble the cartridge also have an effect on its performance; dies used to size the cartridges can be matched to a given weapon's chamber, high precision scales can give more consistent and accurate measures of powder.

The operations performed when handloading are case cleaning, case inspection, remove the fired primer (reloading only), ream or swage crimp from primer pocket (reloading military cases only), lubricate the cases (variable) and resize the case (reloading only), measure and trim the case length (variable) (reloading only), expand the neck to accept the bullet, clean the lubricant from the cases (if applied), seat a new primer, add a volumetrically-measured or weighed amount of powder, seat the bullet in the case, and crimp the bullet in place (optional).

The basic piece of equipment for handloading is the press. A press is a device that uses compound leverage to push the cases into the dies that perform the loading operations. Presses vary from simple, inexpensive single stage models, to complex progressive models that will eject a loaded cartridge with each pull of a lever, at rates of 10 rounds a minute.

Single stage presses are the simplest. They perform one step on one case at a time. When using a single stage press, cases are loaded in batches, one step per batch at a time. Batches are normally small, about 50 cases at a time, so that a batch is not left in a partially completed state. Once a case is primed, it should be finished as soon as possible, since high humidity can degrade the primer.

Progressive presses handle several shells at once, with each pull of the lever performing a single step on all the cases at once. Progressive presses hold all the dies needed, plus a powder measure and a primer feed, and often also include an additional station where the powder levels are checked, to prevent over or under charges. Progressive presses also often feature case feeds that will hold hundreds of cases to be loaded, and all the user has to do is hold the bullet in place over the appropriate case mouth, and pull the lever.

Handloading is a complex and time-consuming process. Like any complex process, mistakes in handloading are easy to make, and it is far better to be safe and re-do a questionable step than to hope things will come out all right. Of all the steps involved in reloading, one of the most critical steps is the step of seating the bullet into the open end of the case or shell. If a bullet is not seated properly into the open end of the shell, it can dislodge or displace before reaching the next stage step in the handloading process. It is well understood among skilled artisans that a properly seated bullet is set neither too deep nor too shallow.

Skilled artisans have devoted considerable effort toward the development and improvement of handloading systems. However, current efforts have not yielded entirely accepetable results. For instance, known handloading systems are expensive, notoriously slow, cumbersome, require specialized skill, and fail to provide the precision tamping and seating of the bullet into the case or shell during the handloading process. Given these and other deficiencies prevelant in the art, the need for continued improvement is evident.

SUMMARY OF THE INVENTION

Bullet feeder apparatus for presenting a bullet in the open end of a shell according to the principle of the invention includes a fixture bounding a bullet-conducting passage therethrough. A gate is mounted to the fixture for movement between a closed position closing the bullet-conducting passage preventing the bullet from passing therethrough, and an open position opening the bullet-conducting passage allowing the bullet to pass therethrough into the open end of the shell. A bias is applied to the gate biasing the gate into the closed position. A deflector is mounted proximate the fixture for movement between a first position and a second position. In the first position of the deflector, the deflector is disposed away from the gate and the bias applied to the gate biases the gate in the closed position thereof closing the bullet-conducting passage. In the second position of the deflector, the deflector is disposed toward and against the gate overcoming the bias applied thereto deflecting the gate from the closed position thereof to the open position thereof opening the bullet-conducting passage. The bias applied to the gate is supplied by a spring acting on the gate. Preferably, the spring is coupled between the fixture and the gate. The deflector consists of an annular body encircling the fixture adjacent to the gate. An opening formed in the fixture leads to the bullet-conducting passage, and the gate is mounted for movement through the opening between the closed and open positions thereof. A seat opposes the fixture, and the deflector is located against the seat in the first position thereof. In the closed position of the gate, the gate is located in the bullet-conducting passage preventing the bullet from passing therethrough. In the open position of the gate, the gate is located away from the bullet-conducting passage allowing the bullet to pass therethrough into the open end of the shell. A feed tube couples the bullet feeder apparatus to a bullet conveyance, which applies bullets to the feed tube from a source of bullets. The bullets each have a tip end and a base end. The bullet conveyance conveys bullets, in tip end down and tip end up positions or orientations, from a source of bullets to the feed tube along a bullet conveyance path. A bullet-orienting structure is disposed proximate the bullet conveyance path. For each tip end down bullet, namely, for each bullet disposed in the tip end down orientation, the bullet-orienting structure interacts with the tip end down bullet and flips the tip end down bullet relative to the bullet conveyance from the tip end down orientation to the tip end up orientation prior to application to the feed tube.

Bullet feeder apparatus for presenting a bullet in the open end of a shell according to the principle of the invention includes a housing, a fixture carried by the housing and bounding a bullet-conducting passage therethrough, and a gate mounted between the housing and the fixture for movement between a closed position closing the bullet-conducting passage preventing the bullet from passing therethrough, and an open position opening the bullet-conducting passage allowing the bullet to pass therethrough into the open end of the shell. A bias is applied to the gate biasing the gate into the closed position. A deflector is mounted between the housing and the fixture for movement between a first position and a second position. In the first position of the deflector, the deflector is disposed away from the gate against a seat formed in the housing and the bias applied to the gate biases the gate in the closed position thereof closing the bullet-conducting passage. In the second position of the deflector, the deflector is disposed away from the seat against the gate overcoming the bias applied thereto deflecting the gate from the closed position thereof to the open position thereof opening the bullet-conducting passage. The bias applied to the gate is supplied by a spring acting on the gate. Preferably, the spring is coupled between the fixture and the gate. The deflector consists of an annular body disposed between the housing and the fixture encircling the fixture adjacent to the gate. An opening is formed in the fixture leading to the bullet-conducting passage, and the gate is mounted for movement through the opening between the closed and open positions thereof. In the closed position of the gate, the gate is located in the bullet-conducting passage preventing the bullet from passing therethrough. In the open position of the gate, the gate is located away from the bullet-conducting passage allowing the bullet to pass therethrough into the open end of the shell. A feed tube couples the bullet feeder apparatus to a bullet conveyance, which applies bullets to the feed tube from a source of bullets. The bullets each have a tip end and a base end. The bullet conveyance conveys bullets, in tip end down and tip end up positions or orientations, from a source of bullets to the feed tube along a bullet conveyance path. A bullet-orienting structure is disposed proximate the bullet conveyance path. For each tip end down bullet, namely, for each bullet disposed in the tip end down orientation, the bullet-orienting structure interacts with the tip end down bullet and flips the tip end down bullet relative to the bullet conveyance from the tip end down orientation to the tip end up orientation prior to application to the feed tube.

Bullet feeder apparatus for presenting a bullet in the open end of a shell according to the principle of the invention includes a fixture bounding a bullet-conducting passage therethrough. A bullet feed tube is coupled to the bullet-conducting passage. A gate is mounted to the fixture for movement between a first position in the bullet-conducting passage, and a second position away from the bullet-conducting passage. A bias is applied to the gate biasing the gate in the first position thereof, and the gate is disposed in the first position. A bullet to be loaded is located in the bullet-conducting passage and is positioned on the gate. A column of bullets in the bullet feed tube is positioned atop the bullet to be loaded. The column of bullets defines a weight applying a tamping force against the bullet to be loaded. A deflector is mounted proximate the fixture for movement between a first position whereby the deflector is disposed away from the gate in the first position thereof, and a second position whereby the deflector is disposed toward and against the gate overcoming the bias applied thereto deflecting the gate from the closed position thereof to the open position thereof opening the bullet-conducting passage. In the open position of the gate, the bullet to be loaded passes into the open end of the shell from the bullet-conducting passage, and the tamping force applied to the bullet to be loaded from the column of bullets tamps the bullet into the open end of the shell. The bias applied to the gate is supplied by a spring acting on the gate. Preferably, the spring is coupled between the fixture and the gate. The deflector consists of an annular body encircling the fixture adjacent to the gate. An opening formed in the fixture leads to the bullet-conducting passage, and the gate is mounted for movement through the opening between the closed and open positions thereof. A seat opposes the fixture, and the deflector is located against the seat in the first position thereof. Preferably, the seat is formed in a housing maintaining the fixture. The feed tube couples the bullet feeder apparatus to a bullet conveyance, which applies bullets to the feed tube from a source of bullets. The bullets each have a tip end and a base end. The bullet conveyance conveys bullets, in tip end down and tip end up positions or orientations, from a source of bullets to the feed tube along a bullet conveyance path. A bullet-orienting structure is disposed proximate the bullet conveyance path. For each tip end down bullet, namely, for each bullet disposed in the tip end down orientation, the bullet-orienting structure interacts with the tip end down bullet and flips the tip end down bullet relative to the bullet conveyance from the tip end down orientation to the tip end up orientation prior to application to the feed tube.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION OF PREFERRED EMBODIMENTS

Figure 1:
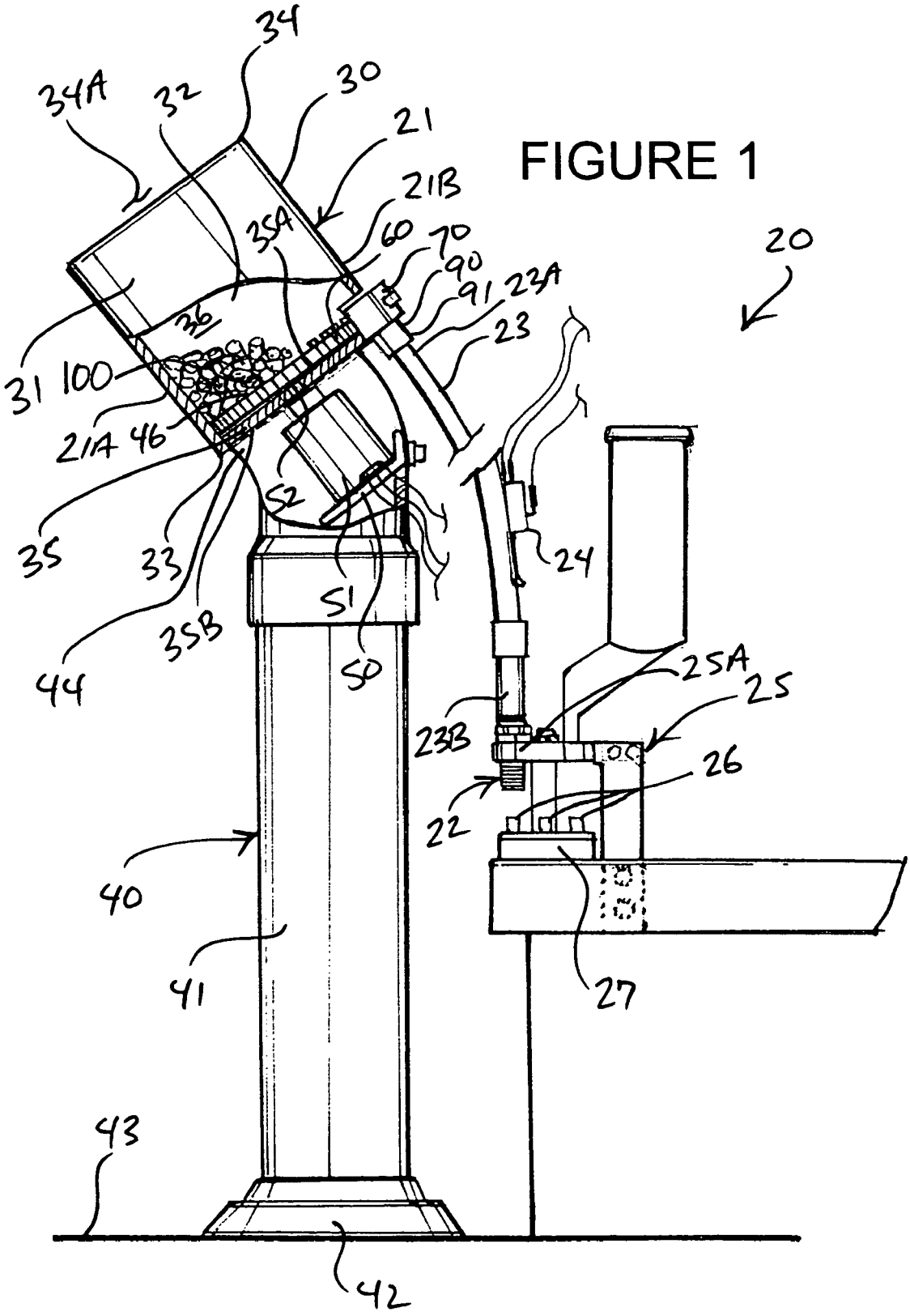
FIG. 1 is a side elevational view of a shell loading system constructed and arranged in accordance with the principle of the invention, the shell loading system including a rotary hopper coupled to a bullet feeder apparatus with a bullet feed tube fashioned with a switch for operating the rotary hopper, with portions of the rotary hopper broken away for illustrative purposes.

Turning now to the drawings, in which like reference characters indicate corresponding elements throughout the several views, attention is first directed to FIG. 1 in which there is seen is a side elevational view of a shell loading system 20 including a rotary hopper 21 coupled to a bullet feeder apparatus 22 with a bullet feed tube 23 fashioned with a switch 24 for interacting with bullets conveyed into tube 23 from rotary hopper 21 for operating rotary hopper 21. Feed tube 23 has an upper end 23A coupled to hopper 21, and a lower end 23B coupled to bullet feeder apparatus 22. Hopper 21 applies bullets into feed tube 23 at upper end 23A, and feed tube 23, in turn, applies bullets to bullet feeder apparatus 22 at lower end 23B. A press 25 manages bullet feeder apparatus 22, which accepts bullets conveyed through tube 23 and presents bullets into cases or shells 26 held by a table 27 of press 25 opposing bullet feeder apparatus 22.

Hopper 21 is located at an elevated location relative to bullet feeder apparatus 22, whereby bullets applied to feed tube 23 by hopper 21 from a source of bullets are gravity feed therethrough feed tube 23 to bullet feeder apparatus 22. Press 25 is exemplary of a conventional single stage press, although the invention can be utilized equally well with a progressive model press.

§A. THE ROTARY HOPPER

Figure 2:
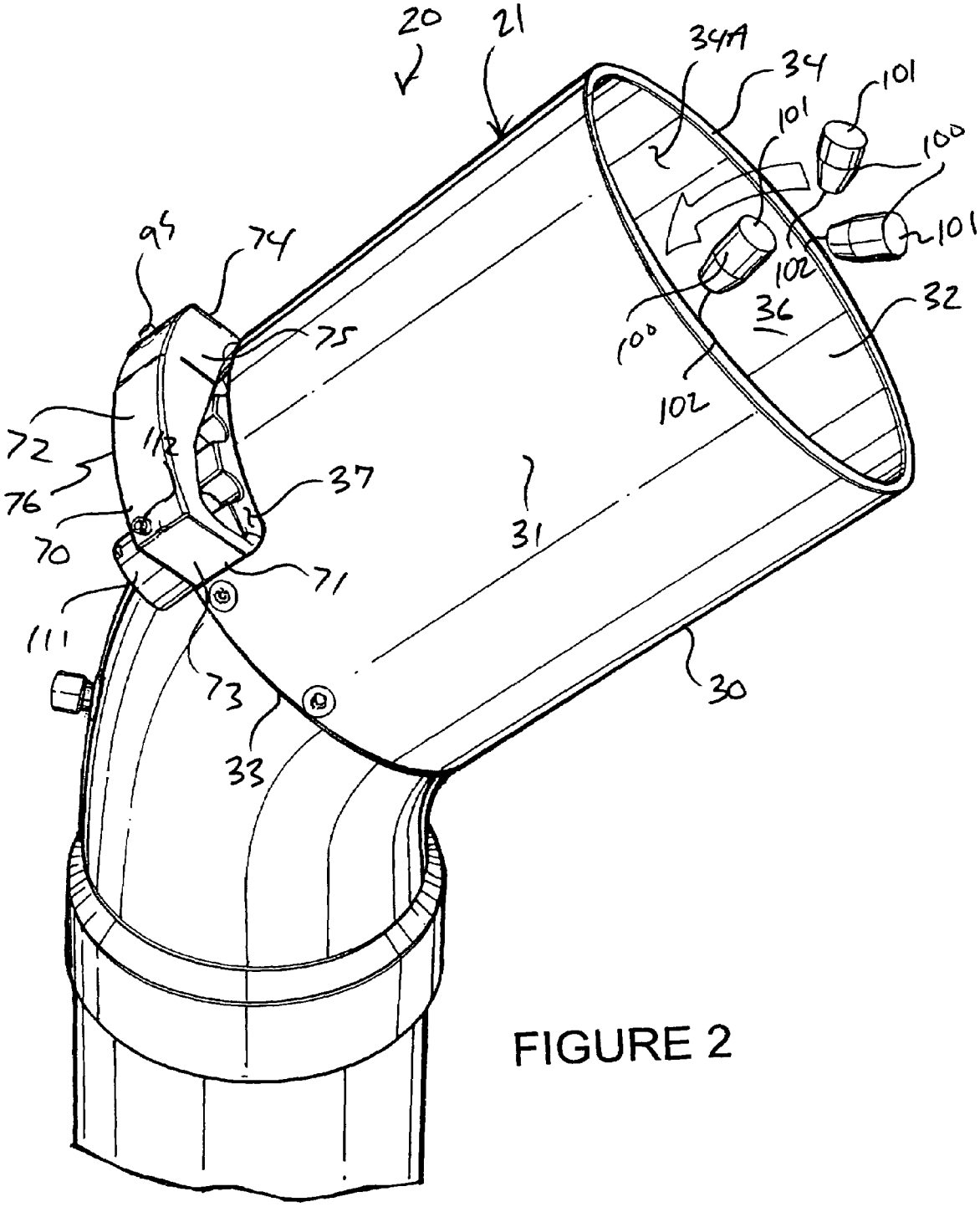
FIG. 2 is an enlarged fragmented perspective view of the rotary hopper of the shell loading system of FIG. 1.
Figure 3:
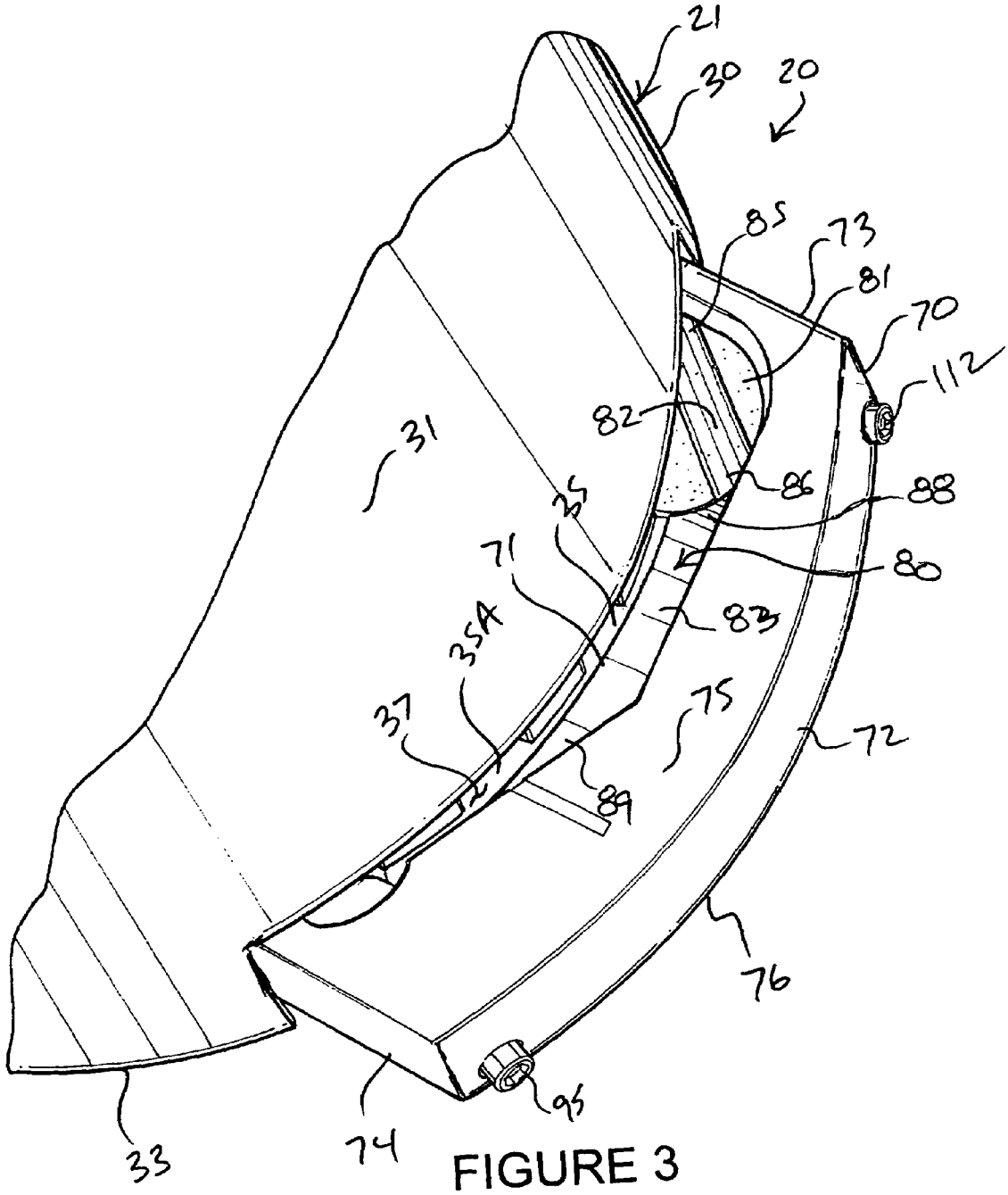
FIG. 3 is an enlarged fragmented top perspective view of the rotary hopper of the shell loading system of FIG. 1 illustrating a bullet-orienting block thereof.
Figure 5:
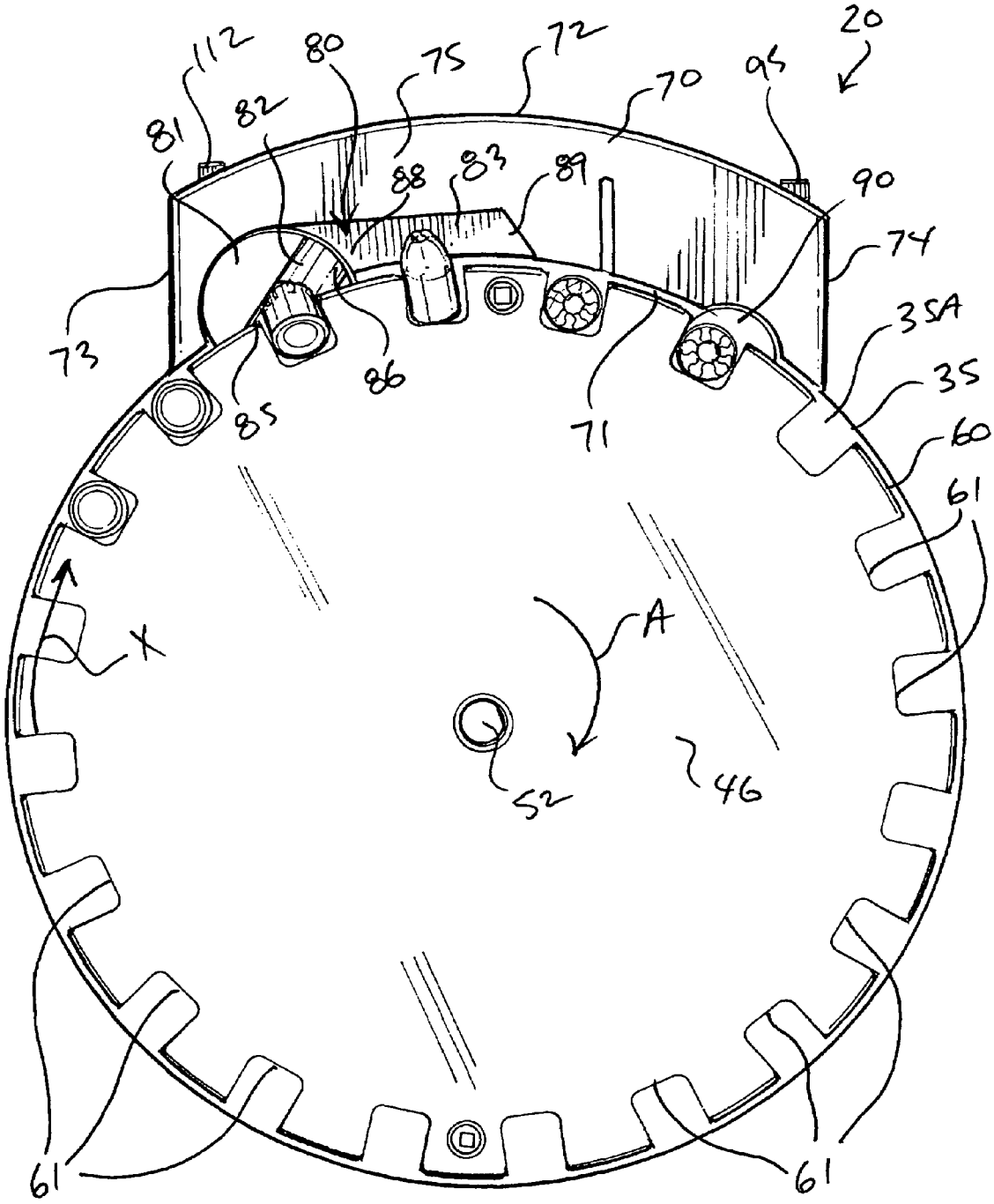
FIG. 5 is a top plan view of a rotary wheel of the shell loading system of FIG. 1 shown as it would appear conducting a bullet relative to the bullet-orienting block of FIG. 3.
Figure 6:
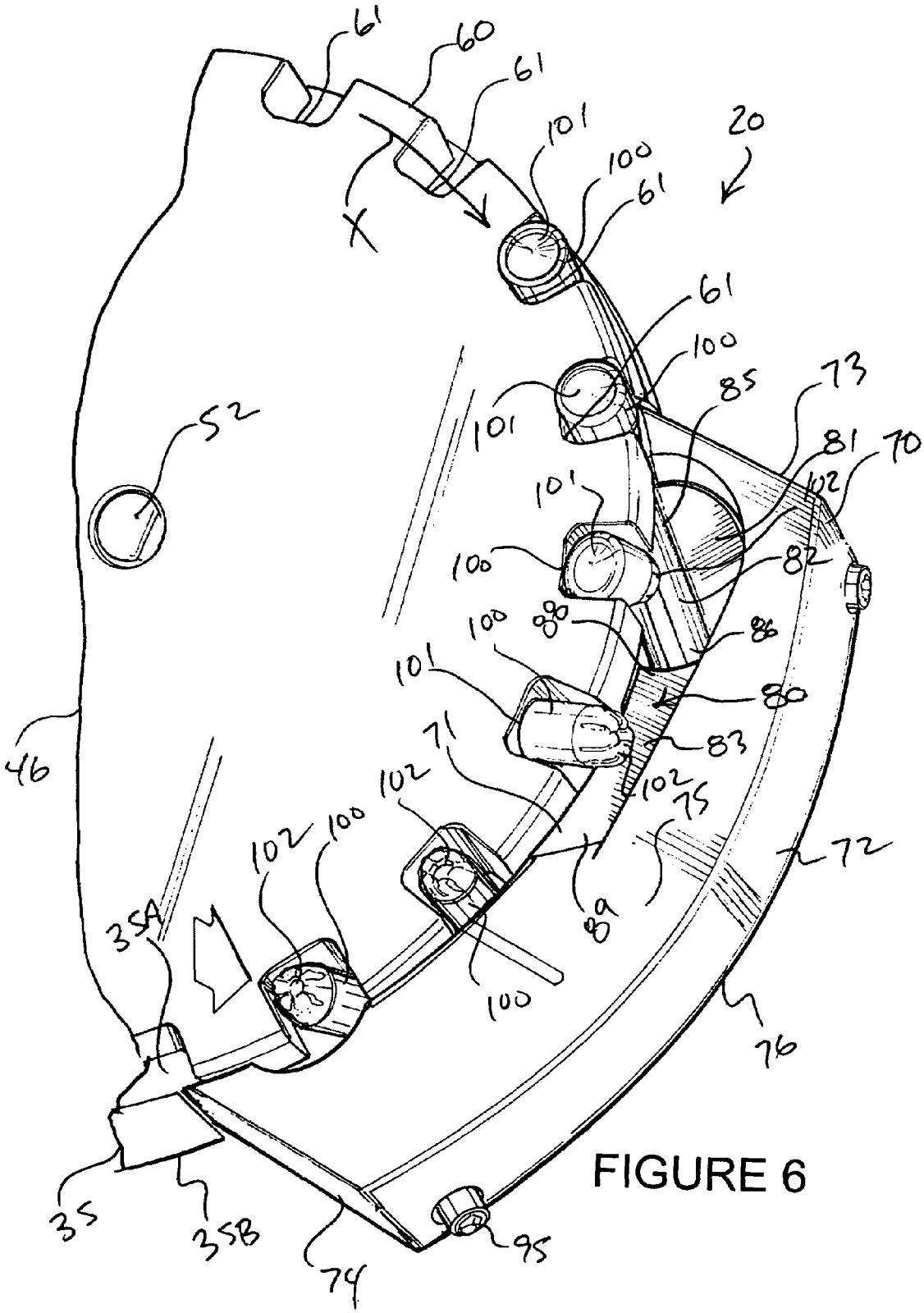
FIG. 6 is a fragmented perspective view of the rotary wheel of FIG. 5 shown as it would appear conducting a bullet relative to the bullet-orienting block.

Rotary hopper 21 is a bullet conveyance that conveys bullets 100 along a bullet conveyance path to feed tube 23 and, which in turn, conveys bullets 100 to bullet feeder apparatus 22. Feed tube 23 couples bullet feeder apparatus 22 to rotary hopper 21, which applies bullets 100 to feed tube 23 from a source of bullets 100 maintained by rotary hopper 21 as seen in FIG. 1. Bullets 100 each have a base end 101 and an opposed tip end 102 as seen in FIG. 2. The bullet conveyance, namely, rotary hopper 21, conveys bullets 100, in tip end 102 down and tip end 102 up positions or orientations, from the source of bullets 100 to feed tube 23 along a bullet conveyance path denoted in FIGS. 5 and 6 by arcuate arrowed line X. A bullet-orienting structure 80 denoted in FIGS. 5 and 6 is disposed proximate bullet conveyance path X. For each tip end down bullet 100, namely, for each bullet 100 disposed in the tip end down orientation, bullet-orienting structure 80 interacts with the tip end down bullet 100 and flips the tip end down bullet 100 relative to the bullet conveyance, i.e., rotary hopper 21, from the tip end 102 down orientation to the tip end 102 up orientation prior to application to feed tube 23.

Looking to FIGS. 1 and 2, rotary hopper 21 includes an upstanding continuous sidewall 30 having an outer surface 31, an inner surface 32, a lower edge 33 and an opposing upper edge 34. Hopper 21 further includes a substantially horizontal bottom 35 affixed to inner surface 32. Bottom 35 has an upper surface 35A and an opposing lower surface 35B. Upper surface 35A of bottom 35 cooperates with inner surface 32 of continuous sidewall 30 bounding a bullet-receiving chamber 36. Upper edge 34 defines an opening leading into chamber 36. Hopper 21 is constructed of a rigid material, such as plastic, metal, wood, or the like. Upper edge 34 bounds an opening 34A into chamber 36.

As seen in FIG. 1, hopper 21 is carried by an upstanding base 40, which supports hopper 21 at an elevated location relative to bullet feeder apparatus 22 and in a tilted attitude. Because hopper 21 is supported in a tilted state, hopper 21 has a down-angled side designated generally at 21A and an up-angled side designated generally at 21B. Base 40 is fashioned of a rigid material such plastic, wood, metal, or the like, and consists of an upstanding, elongate housing 41, having a lower end 42 positioned against a support surface 43, and extends upright therefrom to an upper end 44 onto which hopper 21 is mounted. Base 40 can take any desired shape or form.

A bullet conveyance wheel 46 is located in chamber 34, and is positioned atop upper surface 35A of bottom 35. A bracket 50 is secured to housing 41, such as with screws, bolts or the like, adjacent to upper end 44 of base 40, and is spaced from, and underlies, lower surface 35B of bottom 35. A rotary motor 51 is affixed to bracket 50, such as with screws, bolts, etc. Bracket 50 supports rotary motor 51. Rotary motor 51 is positioned beneath and opposes lower surface 35B of bottom 35 and is operatively coupled to wheel 46 with a drive shaft 52 coupled between rotary motor 51 and wheel 46. Drive shaft 52 extends through bottom 35 of hopper 21 from rotary motor 51 to wheel 46, and is rigidly attached to wheel 46 thereby operatively coupling rotary motor 51 to wheel 46. Upon actuation of rotary motor 51, rotary motor 51 imparts rotation to wheel 46 via drive shaft 52 rotating wheel 46 in a clockwise direction as generally indicated by the arcuate arrowed line A in FIG. 5. Although drive shaft 52 is used to operatively couple rotary motor 52 to wheel 46, other power transfer mechanisms can be used, such as a drive gear assembly, a belt drive assembly, etc.

Looking now to FIG. 5, wheel 46 is a large, flat, circular, integrated disk which is substantially coextensive relative to bottom 32, and includes a perimeter edge 60 directed toward continuous sidewall 30 of hopper 21 as seen in FIG. 1. Bullet-receiving notches 61 are formed in perimeter edge 60 of wheel 46, and are formed at substantially equally-spaced apart intervals along the entire length of perimeter edge 60. Wheel 46 is fashioned of a rigid material such plastic, wood, metal, or the like.

Referring back to FIGS. 1 and 2, hopper 21 is fashioned with a bullet-orienting block 70, which is located at up-angled end 21B, and which is used to ensure that bullets are conveyed to feed tube 23 in the correct orientation, namely, the tip end up orientation. Block 70 is affixed to hopper 21 at bottom 35 as best illustrated in FIGS. 5 and 6. In this preferred embodiment, block 70 projects radially outward from bottom 35 and perimeter edge 60 of wheel 46 through a window 37 (FIGS. 1-4) formed in continuous sidewall 31 proximate closed bottom 32. As seen in FIGS. 2-7, block 70 is an integrated body formed of a rigid material such as plastic, metal, or the like, and includes an inner end 71 affixed to bottom 35 and an opposed outer end 72 extending outwardly therefrom, an upstream end 73 and an opposing downstream end 74, an upper surface 75 and an opposing lower surface 76 best referenced in FIG. 4.

Figure 7:
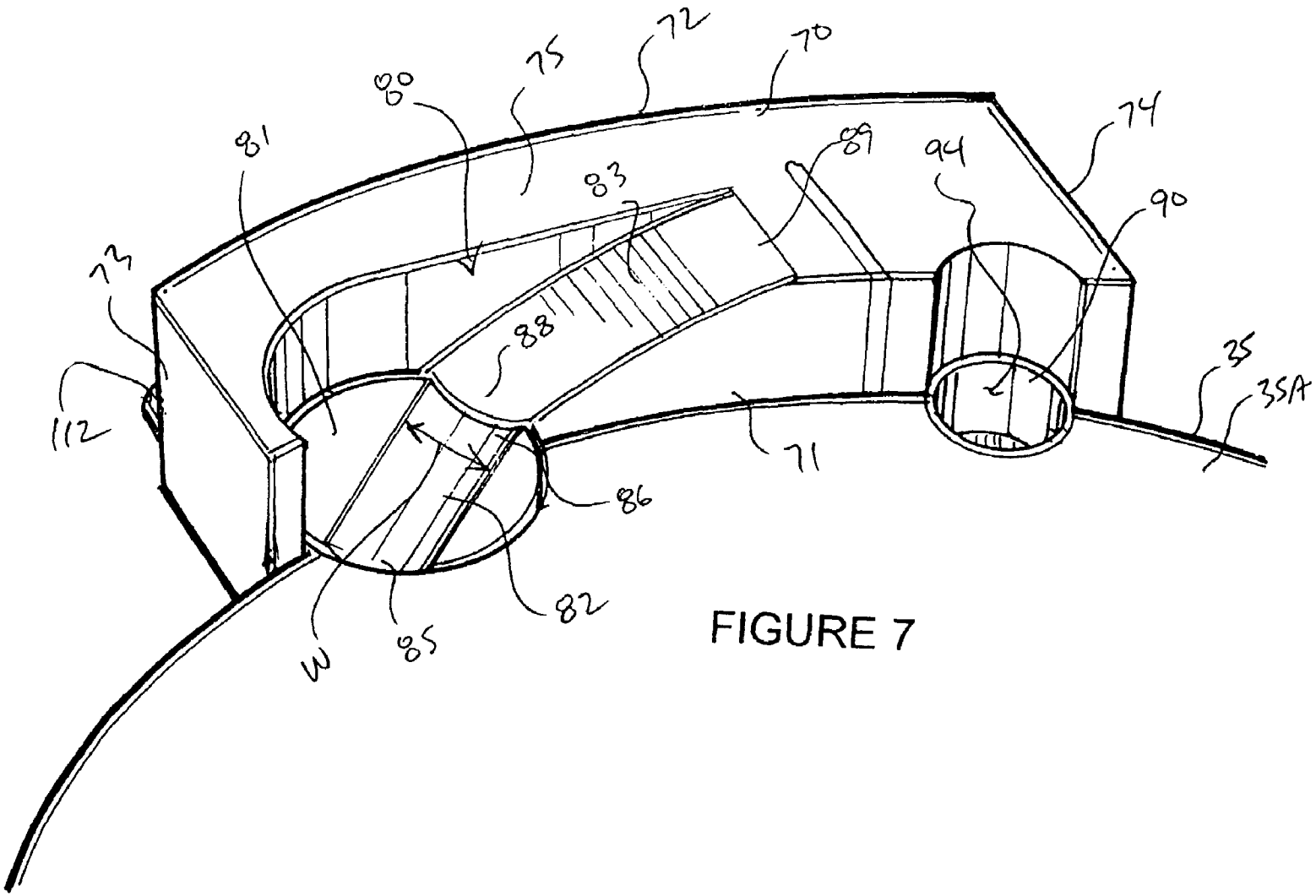
FIG. 7 is a perspective view of the bullet-orienting block of the shell loading system of FIG. 1.

Referring to FIG. 7, block 70 is formed with bullet-orienting structure 80 disposed proximate bullet conveyance path X. Bullet-orienting structure 80 is formed in upper surface 75 of block 70. Bullet-orienting structure consists of a flat stage 81 formed with a groove 82, and a ramp 83. Stage 81 is generally level relative to upper surface 35A of bottom 35, and essentially constitutes an extension of upper surface 35A of bottom 35. Groove 82 formed in stage 81 is oblique relative perimeter edge 60 of wheel 46. Groove 82 has an inner end 85 directed toward perimeter edge 60 of wheel 46 and upstream end 73 of block 70 at inner end 71 of block 70, and extends outwardly therefrom in an oblique angle relative to perimeter 60 of wheel 46 to an outer end 86 directed toward outer end 72 and downstream end 74 of block. Groove 82 has a width W as designated in FIG. 7, which is substantially constant from inner end 85 to outer end 86.

Ramp 83 has a lower end 88 directed located at outer end 86 of groove 82 at stage 81, and ramps upwardly therefrom toward downstream end 74 of block 70 to an upper end 89 at upper surface 75 of block 70. Downstream end 74 of block 70 is fashioned with a nozzle 90 illustrated in FIG. 4, which depends downwardly from block 70 relative to lower surface 76 to an attachment end 91, which is coupled to upper end 23A of feed tube 23. Looking to FIG. 7, a bullet-receiving opening 94 is formed between bottom 35 and inner end 71 of block 70 that communicates with nozzle 90, and which, moreover, accepts nozzle 90. Opening 94 is formed proximate downstream end 74 of block 70.

Figure 4:
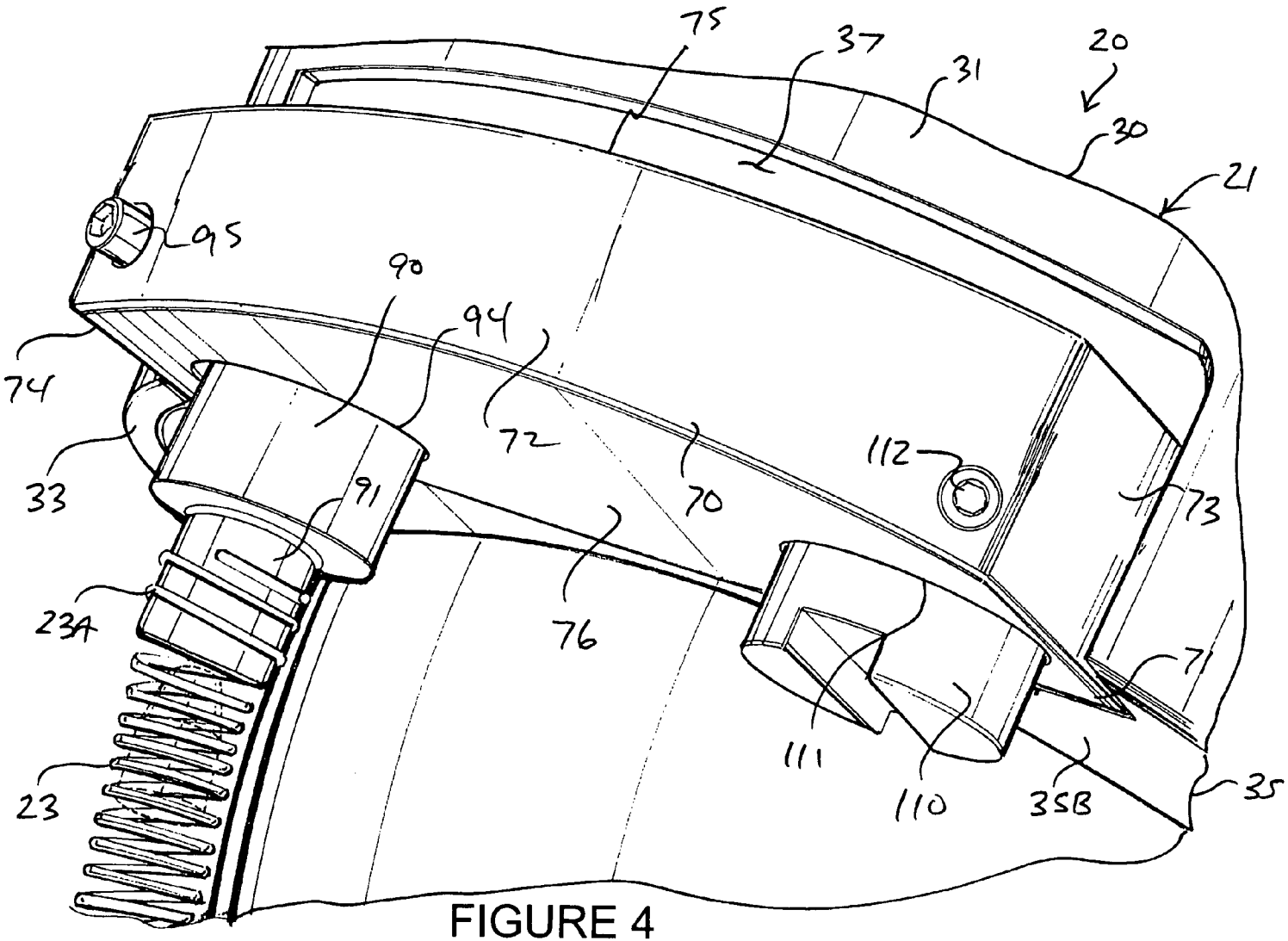
FIG. 4 is an enlarged fragmented bottom perspective view of perspective view of the bullet-orienting block of FIG. 3.

Referring to FIG. 4, nozzle 90 is applied to opening 94, and is secured in place with a locking element, which in this instance is a set screw 95 although any suitable locking element or engagement can be used between nozzle 90 and opening 94 without departing from the invention. Nozzle 90, which is considered part of block 70, can be removed by loosening set screw 95, removing nozzle 90, applying a new nozzle to opening 94, and then securing the newly applied nozzle in place at opening 94 by tightening set screw 95. The ability to replace nozzle 90 with a different nozzle allows nozzle 90 to be replaced if damaged or worn, and to be replaced with differently sized nozzles for accommodating differently-sized bullets. Nozzle 90 may be screwed to block 70, pinned to block 70, or attached to block 70 in other ways. Nozzle 90 may be integrally formed with block 70, if desired.

As previously mentioned, rotary hopper 21 conveys bullets to feed tube 23 along bullet conveyance path X, which in turn conveys the bullets to bullet feeder apparatus 22. In operation, and with reference to FIG. 1, a charge or source of bullets 100 is placed onto wheel 46 in chamber 36 through opening 34A, and rotary motor 51 is activated imparting rotation to wheel 46. As wheel 46 rotates in a clockwise direction as indicated by the arcuate arrowed line A in FIG. 5, bullets 100 are displaced and tumbled through the rotation of wheel 46 and fall into notches 61 at down-angled end 21A of hopper 21 against upper surface 35A of bottom 35 and are conveyed across upper surface 35A of bottom 35 along bullet conveyance path X upwardly to block 70 at up-angled end 21B of hopper 21. Wheel 46 applies bullets 100 in notches 61 to block 70 from upstream end 73 to downstream end 74.

FIGS. 5 and 6 illustrate wheel 46 as it would appear conducting a bullet relative to block 70 along bullet conveyance path X defined by notches 61 at perimeter 60 of wheel 46. Bullets 100 are each identical in size and shape, and include, as referenced in FIGS. 5 and 6, base end 101, which is broad and flat, and opposing tip end 102 which is narrowed and at least somewhat pointed. The width of base end 101 of each bullet 100 is somewhat larger than width W of groove 82, and the width of tip end 102 is less than width W of groove 82, according to the principle of the invention.

Bullets 100 conveyed to feed tube 23 along the bullet conveyance path X must enter upper end 23A of feed tube 23 base end 101 first for permitting bullet feeder apparatus 22 to apply the bullets base ends first to shells during a loading procedure. As wheel 46 rotates, some of the bullets 100 fall into notches 61 tip end 102 first, and others fall into notches 61 base end 101 first. A bullet 100 that falls into a notch 61 base end 101 first is properly oriented, and a bullet 100 that falls into a notch 61 tip end 102 first is improperly oriented and is flipped 180 degrees into the proper tip end 102 up orientation by the provision of block 70. As wheel 46 applies bullets 100 in notches 61 to block 70 from upstream end 73 to downstream end 74 along bullet conveyance path X, the bullets 100 in the improper tip end 102 down position in notches 61 interact with bullet-orienting structure 80 and are flipped 180 degrees in notches 61 into the proper tip end 102 up orientation and then applied to nozzle 90 through opening 94.

FIGS. 5 and 6 each illustrate a bullet 100 in six different positions as conveyed by wheel 46 along block 70 at bullet conveyance path X. In the first position, bullet 100 is received in notch 61 tip end 102 first, which is an improper bullet orientation. As wheel 46 continues to rotate, it conveys bullet 100 along block 70 from upstream end 73 to nozzle 90 located proximate downstream end 74. As bullet 100 is drawn along block 70, it interacts with bullet-orienting structure 80 of block 70 and is rotated 180 degrees from the improper tip end 102 down orientation to the proper tip end 102 up orientation, in accordance with the principle of the invention.

In particular, as wheel 46 rotates bullet 100 is conveyed from the first position toward a second position to upstream end 73 of block 70 and from there to a third position at inner end 85 of groove 82 at stage 81. Because the width of tip end 102 is less than the width W (FIG. 7) of groove 82, when tip end 102 reaches inner end 85 of groove 82 tip end 102 is applied into groove 82 and bullet 100 falls into groove 82 and is displaced outwardly away from perimeter 60 of wheel 46, which marks the start of the 180 degree rotation of bullet 100 in notch 61 from the improper tip end 102 down orientation to the proper tip end 102 up orientation. As wheel 46 continues its rotation, the application or interaction of tip end 102 with groove 82 draws tip end 102 outwardly along groove 82 to outer end 86 of groove 82 causing bullet 100 to continue its rotation in notch 61 from the improper tip end 102 down orientation. The continued rotation of wheel 46 draws bullet 100 along block 70 from its third position toward downstream end 74 of block 70, whereby tip end 102 is drawn past outer end 86 of groove 82 and is applied to lower end 88 of ramp 83. Tip end 102 is drawn upwardly along ramp 83 as wheel 46 continues its rotation to a fourth position of bullet 100 between lower end upper ends 88 and 89 of ramp 83 and from there to a fifth position past upper end 89 of ramp 83, whereby the application or interaction of tip end 102 of bullet 100 along ramp 83 causes the continued rotation of bullet 100 in notch 61 into the proper tip end 102 up orientation in notch 61 as indicated by the fifth position of bullet 100 past upper end 89 of ramp 83. The continued rotation of wheel 46 then draws bullet 100, now in the proper tip end 102 up orientation, along block 70 from its fifth position toward downstream end 74 of block 70 to a sixth position, in which bullet 100 is applied to upper end 23A of feed tube 23 through nozzle 90 from opening 94, and feed tube 23 applies the bullet 100 to bullet feeder apparatus 22 as illustrated in FIG. 1. This process is repeated for each bullet 100 that is applied to block 70 in the improper tip end 102 down orientation.

Because the width of the base end 101 of each bullet 100 is greater than the width W of groove 82 as referenced in FIG. 7, when a bullet is applied to block 70 in the proper tip-up orientation, the base end 101 is prevented from falling into groove 82 and the bullet will simply be conveyed by wheel 46 along block to nozzle 90 and applied base end 101 first into upper end 23A of feed tube 23 through nozzle 90, in accordance with the principle of the invention.

The provision of block 70 ensures that all bullets applied to upper end 23A of feed tube 23 are applied in the proper tip end 102 up orientation, which ensures that bullets are applied base end 101 first into awaiting shells by bullet feeder apparatus 22 illustrated in FIG. 1. Block 70 is easy to construct, and may be incorporated with any suitable rotary hopper 21. In this regard, it is to be understood that, with the exception of block 70, hopper 21 is generally representative of a conventional rotary hopper. Furthermore, although floor-mounted base 40 is used to support hopper 21 at an elevated location relative to bullet feeder apparatus 22 for allowing bullets applied to upper end 23A of feed tube 23 to be gravity feed to lower end 23B of feed tube 23 coupled to bullet feeder apparatus 22, hopper 21 can be table-mounted, wall-mounted, or otherwise suspended in place in any desired manner.

In the present embodiment, wheel 46 applies bullets 100 to block 70 from upstream end 73 to downstream end 74 through clockwise rotation. If desired, wheel 46 can apply bullets 100 to block 70 from upstream end 73 to upstream end through counterclockwise rotation simply by reversing structure 80 of block 70. Furthermore, stage 81 and groove 82 are formed in a plug 110 applied to an opening 111 formed block 70 proximate upstream end 73 as shown in FIG. 4, which is secured in place with a locking element, which in this instance is a set screw 112 although any suitable locking element or engagement can be used between plug 110 and opening 111 without departing from the invention. Plug 110, which is considered part of block 70, can be removed by loosening set screw 112, removing plug 110, applying a new plug to opening 11, and then securing the new plug in place at opening 111 by tightening set screw 112. The ability to replace plug 110 with a different plug allows plug 110 to be replaced if damaged or worn, and to be replaced with different plugs having grooves of varying widths for allowing hopper 21 to be used with differently-sized bullets. Plug 110 may be screwed to block 70, pinned to block 70, or attached to block 70 in other ways. Stage 81 and groove 82 may be integrally formed with block 70, if desired.

In the present embodiment, block 70 is affixed to bottom 35 of hopper 21. Consistent with the teachings relating to the bullet-orienting structure 80 of block 70, block 70 can be attached to hopper 21 at other locations, such as to sidewall 30. Furthermore, bullet-orienting structure 80 may, if desired, be formed in sidewall 30.

§B. THE BULLET FEEDER APPARATUS

Figure 8:
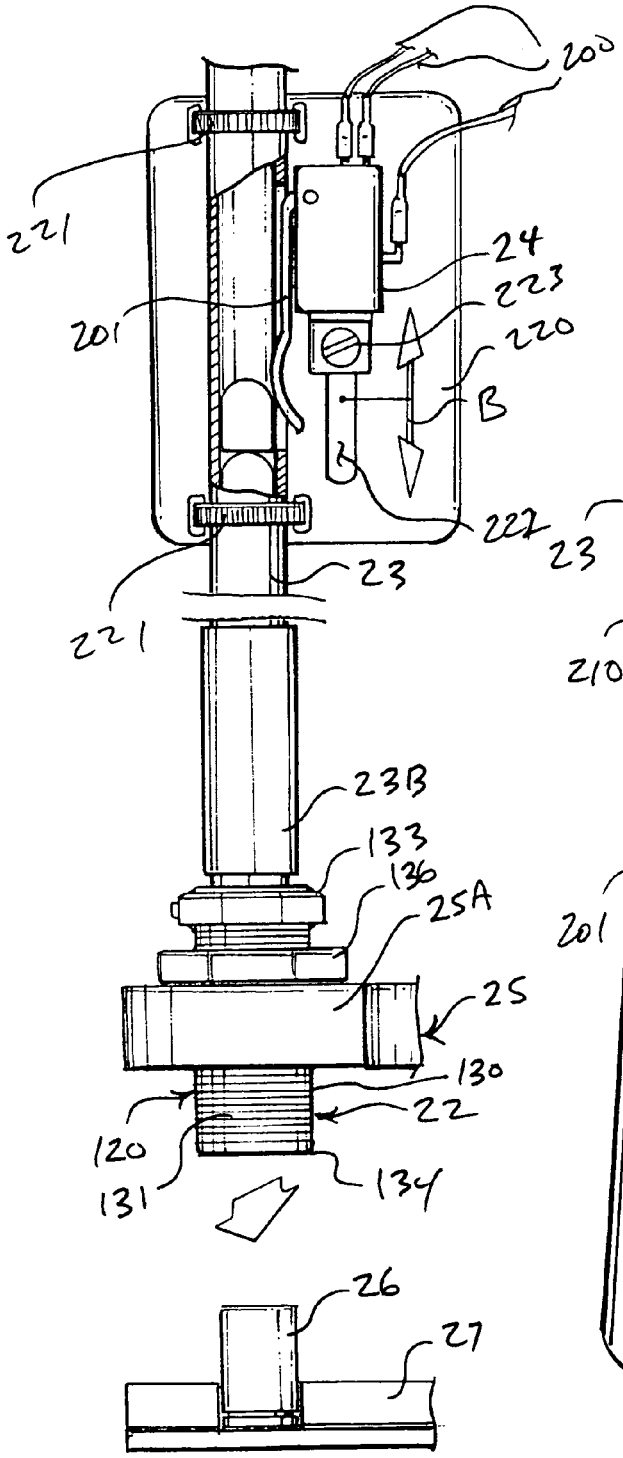
FIG. 8 is a partially schematic side elevational view of the bullet feeder apparatus coupled to the bullet feed tube incorporating the switch of the shell loading system of FIG. 1.

As previously mentioned, hopper 21 applies bullets into feed tube 23 at upper end 23A, and feed tube 23, in turn, applies bullets to bullet feeder apparatus 22 at lower end 23B, as illustrated in FIG. 8. Bullet feeder apparatus 22 is provided to seat bullets into the open ends of shells.

Figure 10:
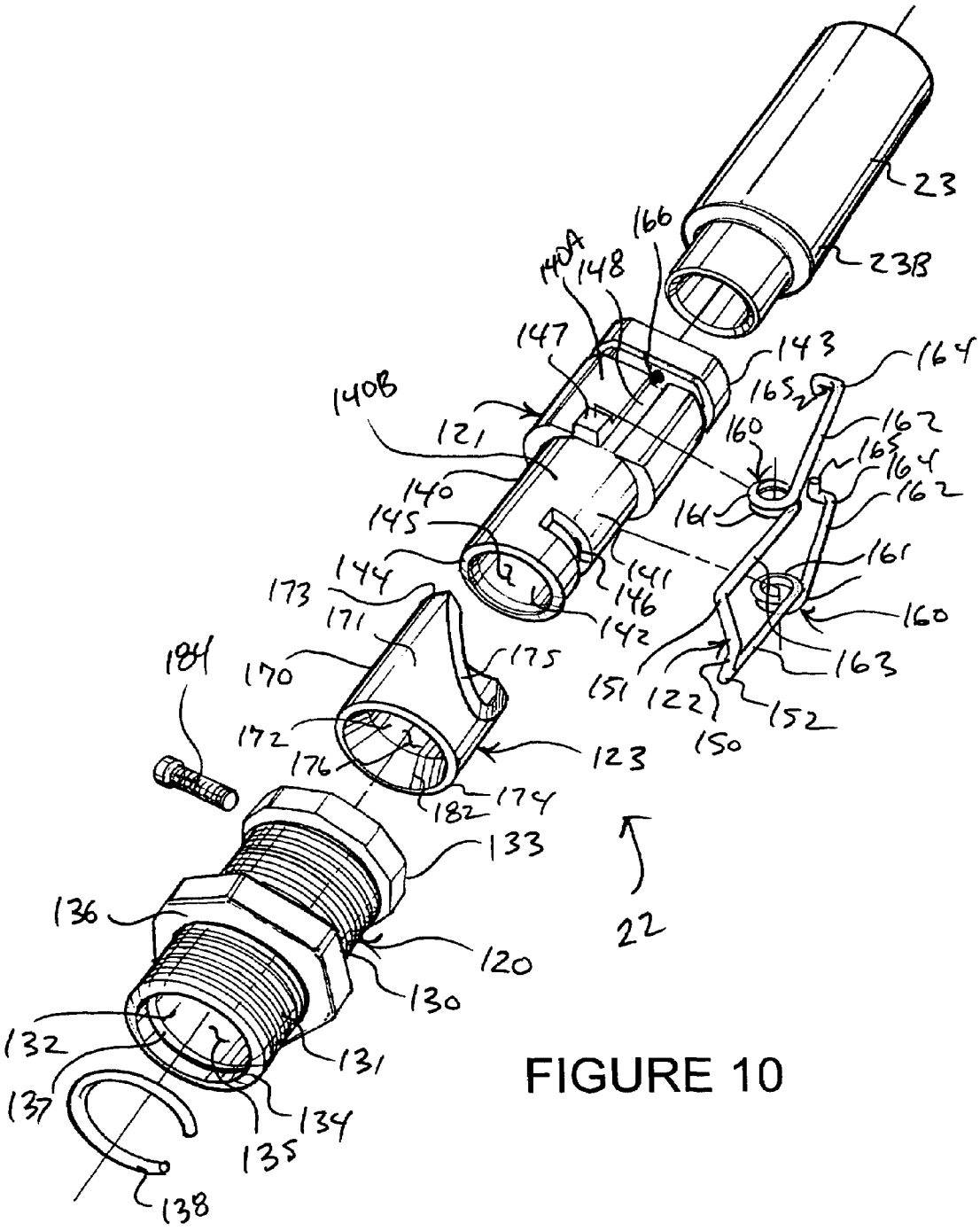
FIG. 10 is an exploded perspective view of the bullet feeder apparatus of the shell loading system of FIG. 1.

Turning to FIG. 10, bullet feeder apparatus 22 consists of a housing 120, a fixture 121, a gate 122, and a deflector 123. Housing 120 maintains fixture 121, gate 122, and deflector 23. Housing 120 includes a continuous sidewall 130 having an outer surface 131, an inner surface 132, an upper edge 133 and an opposing lower edge 134. Inner surface 132 bounds a chamber 135, which extends through housing 120 from upper edge 133 to lower edge 134. Upper edge 133 defines the open upper end of housing 120 into chamber 135, and lower edge 134 defines the open lower end of housing 120 from chamber 135. Housing is constructed of a rigid material, such as plastic, metal, or the like. Continuous sidewall 130 is cylindrical, and outer surface 131 is externally threaded, and is threadably applied to a threaded bore formed in a support 25A of press 25 overlying and opposing table 27 as illustrated in FIGS. 1 and 8. A nut 136 threaded onto threaded outer surface 131 is tightened against support 25A, which secures housing 120 to support 25A. An annular groove 137 is formed in inner surface 132, which accepts a C-ring 138 forming a seat of housing directed inwardly relative to inner surface 132. The seat of housing 120 can be integrally formed with inner surface 132, if desired. Housing 120 may be applied and secured to press 25 in any suitable way commensurate with the skill attributed to the skilled artisan.

Figure 11:
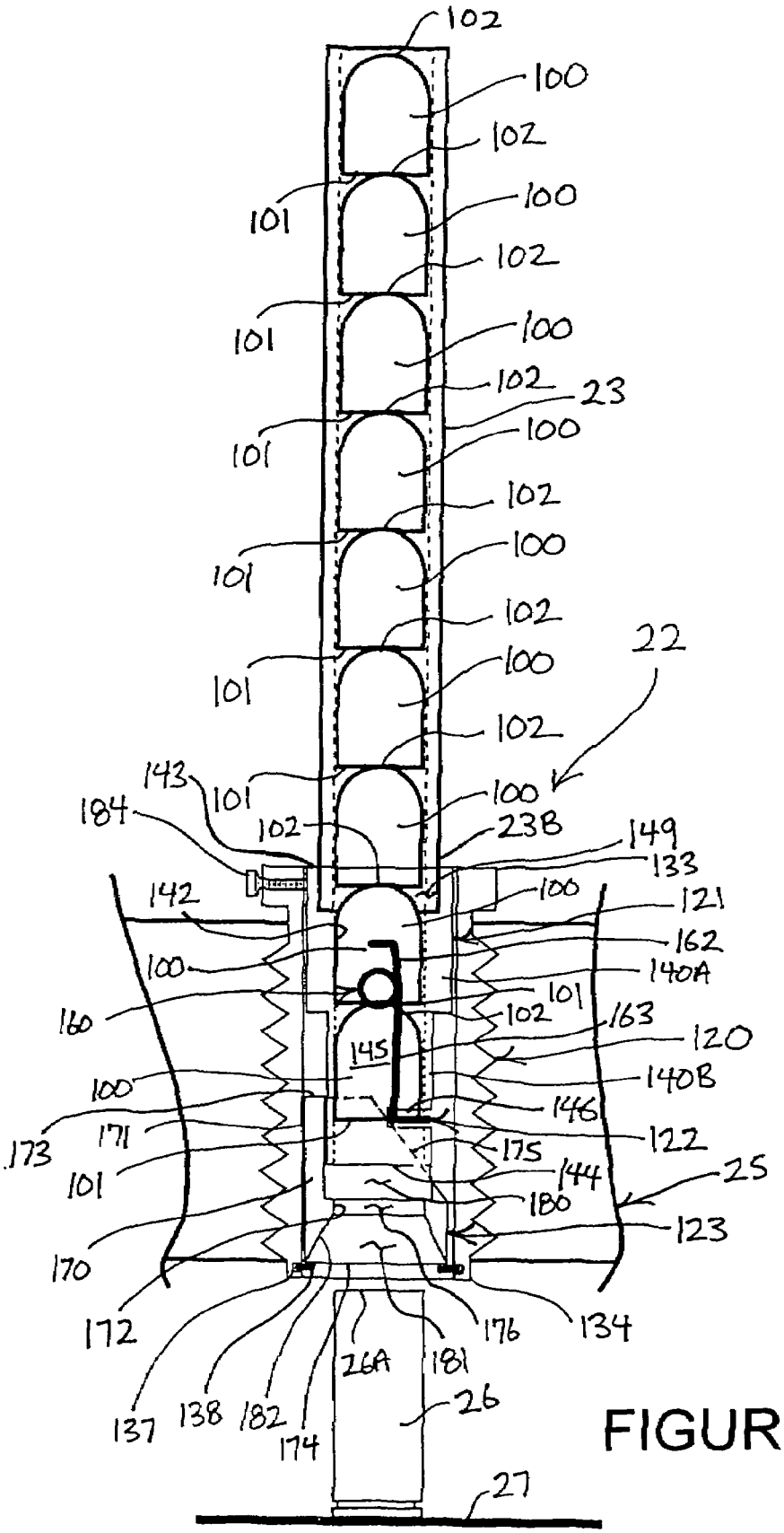
FIG. 11 is a schematic representation of the bullet feed tube shown as it would appear feeding bullets to the bullet feeder apparatus of the shell loading system of FIG. 1.

Fixture 121 is an integrated body including a continuous sidewall 140 having an outer surface 141, an inner surface 142, an upper edge 143 and an opposing lower edge 144. Inner surface 142 bounds a bullet-conducting passage 145, which extends through fixture 121 from upper edge 143 to lower edge 144. Upper edge 143 defines the open upper end of fixture 121 into passage 145, and lower edge 144 defines the open lower end of fixture 121 from passage 145. Fixture 121 is formed of a rigid material, such as plastic, metal, or the like. An opening 146 is formed in continuous sidewall 140 adjacent to lower edge 144. Opening 146 is elongate, and is transverse relative to the longitudinal axis of fixture 121. Continuous sidewall is formed with an enlarged head 140A directed toward upper edge 143, and a narrowed neck 140B directed toward lower edge 144. In particular, head 140A extends from upper edge 143 downwardly to a termination point between upper and lower edges 143 and 144, and narrowed neck 140B extends upwardly from lower edge 144 to the termination point of head 140A. As best seen in FIG. 11, a counterbore 149 is formed in inner surface 142 of fixture 121, which extends downwardly from upper edge 143 and which accepts lower end 23B of feed tube 23.

Gate 122 consists of an elongate member 150 having opposed ends 151 and 152. Gate 122 is applied to fixture 121 at opening 146 formed in continuous sidewall 140 adjacent to lower edge 144. A pair of opposed tension springs 160 are coupled to gate 122, each of which include a wire formed into two coils 161 encircling a pin 147 (only one shown) projecting outwardly from outer surface 141 on either side of continuous sidewall 140. One coil 161 leads to an upper tag end 162, and the other coil 161 leads to a lower tag end 163. Tension springs 160 each incorporate two outermost coils, namely, coils 161. One or more intermediate coils can be applied between coils 161 in conjunction with tension springs 160, if desired. Tension springs 160 are fashioned of spring steel, a nickel-based spring alloy, or other material or combination of materials having a substantially constant moduli of elasticity as is typical with tension springs.

Upper tag ends 162 are secured to fixture 121, and lower tag ends 163 are secured to gate 122. In particular, lower tag ends 163 project downwardly alongside outer surface 141 of continuous sidewall 140 toward lower edge 144 of continuous sidewall 140 and are affixed to the respective ends 151 and 152 of gate 122, whereby gate 122 is supported by and between lower tag ends 163 and is maintained at opening 146.

Figure 13:
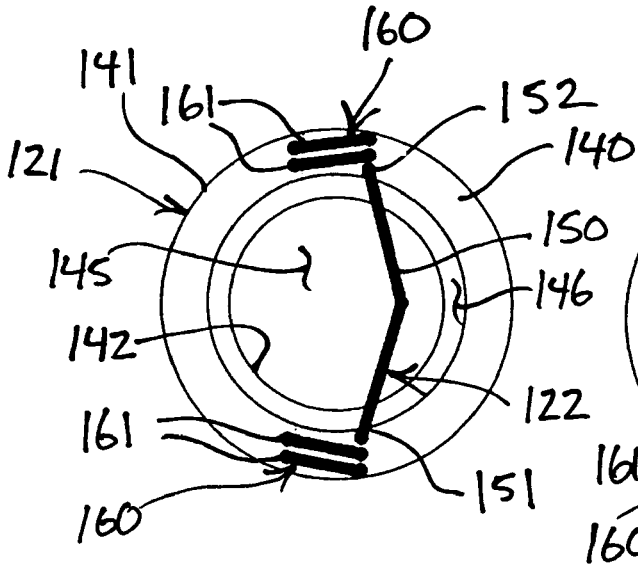
FIG. 13 is a schematic representation of the bullet feeder apparatus of the shell loading system of FIG. 1 shown as it would appear closed.
Figure 14:
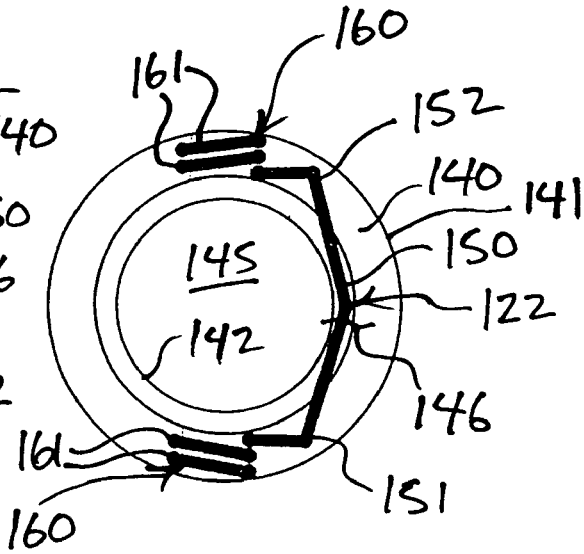
FIG. 14 is a view very similar to that of FIG. 13 illustrating the bullet feeder apparatus as it would appear open.

Upper tag ends 162 extend upwardly toward upper edge 143 of continuous sidewall 140, and are applied in vertical grooves 148 (only one shown) formed in outer surface 141 of continuous sidewall 140. Upper tag ends 162 terminate with a free end 164 formed with a key 165 situated in a continuous, transverse groove 166 formed in outer surface 141 on either side of continuous sidewall 140. Because upper tag ends 162 are secured to fixture 121, and lower tag ends 163 are secured to gate 122, springs 160 apply a bias to gate 122 biasing gate 122 in a closed position into bullet-conducting passage through opening 146. In the closed position of gate 122, gate 122 extends in and across bullet-conducting passage 145 as seen in FIG. 13 obstructing bullet-conducting passage 145. Tag ends 162 and 163, tension springs 160, and gate 122 are preferably fashioned from an integrated strand of metal spring material, such as spring steel or the like.

Deflector 123 is an integrated body including a continuous sidewall 170 having an outer surface 171, an inner surface 172, an upper edge 173 and an opposing lower edge 174. An angled cross section of continuous sidewall 170 is removed, such as by cutting, from upper edge 173 terminating at a point intermediate upper and lower edges 173 and 174 proximate lower edge 174, forming an angled edge or surface 175 angled upwardly away from lower edge 174. Inner surface 172 defines a bullet-conducting passage 176 of deflector 123, which extends through deflector 123 from upper edge 173 to lower edge 174. Deflector 123 is formed of a rigid material, such as plastic, metal, or the like. Upper edge 173 and angled edge or surface 175 define the open upper end of deflector 123, and lower edge 174 defines the open lower end of deflector 123.

Looking to FIG. 11, a counterbore 180 is formed in inner surface 172 of deflector 123, which extends downwardly from upper and angled edges 173 and 175 to a point intermediate upper and lower edges 173 and 174. An inverted cone 181, formed by a bevel 182 formed in inner surface 172, is formed in inner surface 172 of deflector 123, which extends upwardly from lower edge 174 to the entrance of passage 176 through deflector 123.

With continuing reference to FIG. 11, deflector 123 is applied lower edge 174 first into chamber 135 of housing 120 at upper edge 133, and lower edge 174 of deflector 123 is seated against the seat of housing 120, which in this instance is formed by C-ring 138. Fixture 121 is, in turn, applied lower edge 144 first into chamber 135 of housing 120 at upper edge 133, and lower edge 144 is received in counterbore 180 such that angled surface 175 faces upwardly toward gate 122 and continuous sidewall 170 encircles neck 140B at lower edge 144. Deflector 123 is captured between the seat of housing 120 formed by C-ring 38 and fixture 121. Fixture 121 is secured in place to housing 120 with a locking element, which in this instance is a set screw 184, applied between head 140A of fixture 121 housing 120 proximate upper edge 133. Although set screw 184 is used to secure fixture 121 at chamber 135 of housing 120, other forms of locking elements can be used without departing from the invention. Furthermore, fixture 121 can be threaded to housing 120, pinned to housing 120, or affixed to housing 120 in other ways.

Deflector 123 and neck 140B of fixture 121 are free to reciprocate relative to each other at counterbore 180 between a lowered position of deflector 123 away from lower edge 144 of fixture 121 and gate 122 directing lower edge 174 of deflector 123 against the seat of housing 120 formed by C-ring 138, and a raised position of deflector 123 away from the seat of housing 120 formed by C-ring toward lower edge 144 of fixture 121 and gate 122. In the lowered position of deflector 123, deflector 123 is in a resting position against the seat of housing 120 and gate 122 is outside of the influence of deflector 123 and therefore springs 160 are free to bias gate 122 into its closed position closing bullet-conducting passage 145, in which gate 122 is disposed in, and extends across, bullet-conducting passage 145 of fixture 121 as shown in FIG. 13 preventing bullets from passing through bullet-conducting passage 145. In the raised position of deflector 123 as shown in FIG. 12C, angled surface 175 is applied against gate 122 overcoming the bias applied by springs 160 deflecting gate 122 into its open position opening bullet-conducting passage 145, in which gate 122 is located away from bullet-conducting passage 145 at opening 146 allowing bullets to pass through bullet-conducting passage 145 to bullet-conducting passage 176 of deflector 123 and from there into the open end of an awaiting shell.

Bullet feeder apparatus 22 functions to apply and seat bullets into the open ends of shells. FIGS. 12A-12E illustrate the sequence of operation of bullet feeder apparatus 22 applying/presenting and tamping a bullet in open end 26A of shell 26 maintained on table 27. The illustrations in FIGS. 12A-12E are generalized and relatively small. Accordingly, not all reference characters of the structural features of bullet feeder apparatus 22 discussed in conjunction FIGS. 12A-12E are referenced therein, in which case reference is to be made back to FIGS. 10 and 11 in relevant part.

In FIGS. 12A-12E, bullet feeder apparatus 22 is maintained and managed by press 25, which supports bullet feeder apparatus 22 above table 27. Bullets 100 enter bullet feeder apparatus 22 at the open upper end of fixture 121, are conveyed through the bullet-conducting passage 145 of fixture 121, and are applied to the open ends of shells from bullet-conducting passage 176 of deflector 123 from the open lower end of fixture 121 defined by lower edge 144 of fixture 121. FIGS. 12A-12E illustrate the operation of bullet feeder apparatus 22 in a bullet-tamping stroke or cycle. In the present embodiment, the movement of table 27 moving shell 26 relative to bullet feeder 22 characterizes the bullet-tamping cycle. However, the bullet-tamping cycle may also be carried out through the movement of bullet feeder apparatus 22 relative to shell 26, or the concurrent or joint movement of bullet feeder apparatus 22 and shell 26.

Figures 12A, 12B, 12C, 12D, 12E:
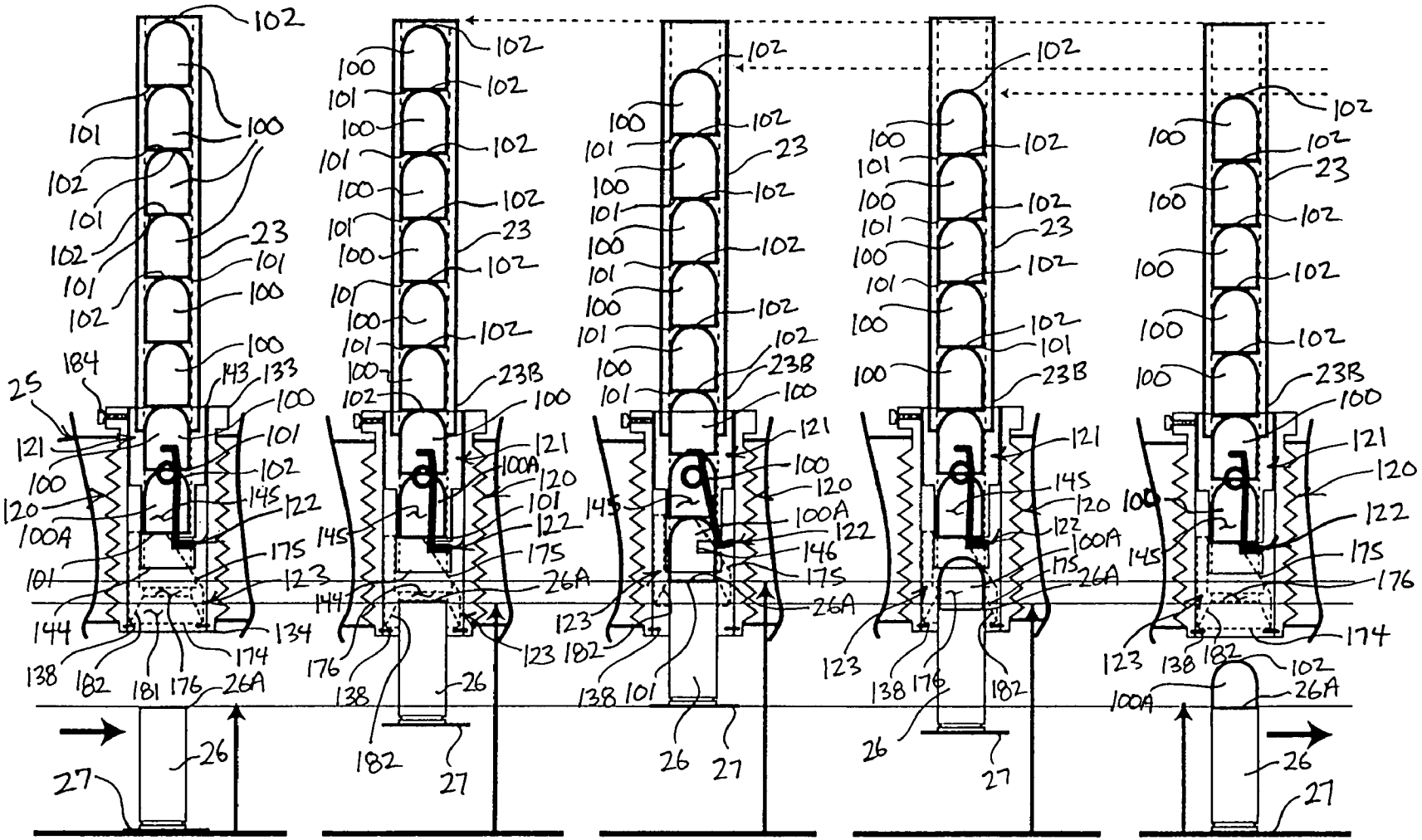
FIG. 12A-12E are schematic representations illustrating a sequence of operation of the bullet feeder apparatus of the shell loading system of FIG. 1.

In FIG. 12A, shell 26 is set on table 27, table 27 is disposed in a starting position locating shell 26 away from bullet feeder apparatus 22, bullet feeder apparatus 22 overlies shell 26, deflector 123 is at rest in the lowered position thereof against the seat of housing 120, and gate 122 is biased by springs 160 into the closed position thereof closing bullet-conducting passage 145 of fixture 121. Bullet feeder apparatus 22 is set upright, whereby the upper open ends of housing 120 and fixture 121 are directed upwardly at lower end 23B of feed tube, and deflector 123 and the lower open ends of housing 120 and fixture 121 are directed downwardly toward shell 26.

A column of bullets 100 is applied to feed tube 23 from hopper 21 (not shown in FIG. 1). One of the bullets 100 of the column of bullets 100 is received into bullet-conducting passage 145 of fixture from the open upper end of fixture 121 defined by upper edge 143. Bullets 100 are in the proper tip end 102 up position, and are stacked in feed tube 23 one atop the other base end 101 to tip end 102. The bullet resting base end 101 first on gate 123 is the bullet to be loaded, and bears the reference numeral 100A to differentiate it from the other bullets 100 forming the column extending upwardly therefrom into feed tube 23. It is to be understood that a bullet resting on gate 122 to be set into the open end of a shell is the bullet to be loaded.

Shell 26 extends upright from table 27 to open end 26A, which is directed toward bullet feeder apparatus 22. To seat bullet 100A into open end 26A of shell 26, table 27 is raised moving open upper end 26A into and through cone 181 and into contact against beveled surface 182 underlying and opposing bullet-conducting passage 176 of deflector 123 as shown in FIG. 12B. The outer diameter of shell 26 at open upper end 26A is somewhat greater than the internal diameter of bullet-conducting passage 176 defined by inner surface 172 of deflector 123. As table 27 is raised, the application of shell 26 against beveled surface 182 displaces deflector 123 from the lowered position thereof to the raised position thereof as shown in FIG. 12C, in which angled edge or surface 175 is applied against gate 122 through the force applied against shell 26 by table 27 overcoming the bias applied by springs 160 deflecting gate 122 into its open position locating gate 122 away from bullet-conducting passage 145 thereby opening bullet-conducting passage 145, at which point bullet 100A passes from bullet-conducting passage 145 through the open lower end of fixture 121 defined by lower edge 144 and into open end 26A of shell 26 base end 101 first through bullet-conducting passage 176 of deflector 123.

Bullets 100 each have a weight. The combined weight of the bullets 100 forming the column of bullets 100 resting atop the bullet to be loaded designated at 100A applies a tamping force against bullet 100A sufficient to tamp bullet 100A into open end 26A of shell 26 in the operation of bullet feeder apparatus 22, in accordance with the principle of the invention, which prevents the tamped bullet 100 from dislodging from open end 26A as the formed cartridge is conveyed to the next operation in the bullet-loading process, which is seating the bullet to a specified depth and crimping shell 26 to bullet 100.

After bullet 100A is applied to open end 26A of shell 26 and tamped into open end 26A through the weight of the column of bullets 100, table 27 is drawn away from bullet feeder apparatus 22 as shown in FIG. 12D and back to its starting position as shown in FIG. 12E. When table 27 is drawn away from bullet feeder apparatus 22, the forcible influence applied to deflector 123 by shell 26 disposing deflector 123 in the raised position thereof is removed, springs 160 act on gate 122 and bias gate 122 back to its closed position, which in turn acts on angled surface 175 forcing deflector 123 from its raised position to its lowered position against the seat of housing 120 outside of the influence of deflector 123. As gate 122 moves back into its closed position in bullet-conducting passage 145, gate 122 runs along tip end 102 of bullet 100A and is applied under base end 101 of the succeeding bullet 100, which sits thereon and is thereby prevented or otherwise captured from passing through bullet-conducting passage 145. This bullet-tamping cycle is repeated for each bullet 100.

§C. THE SWITCH

Figure 9:
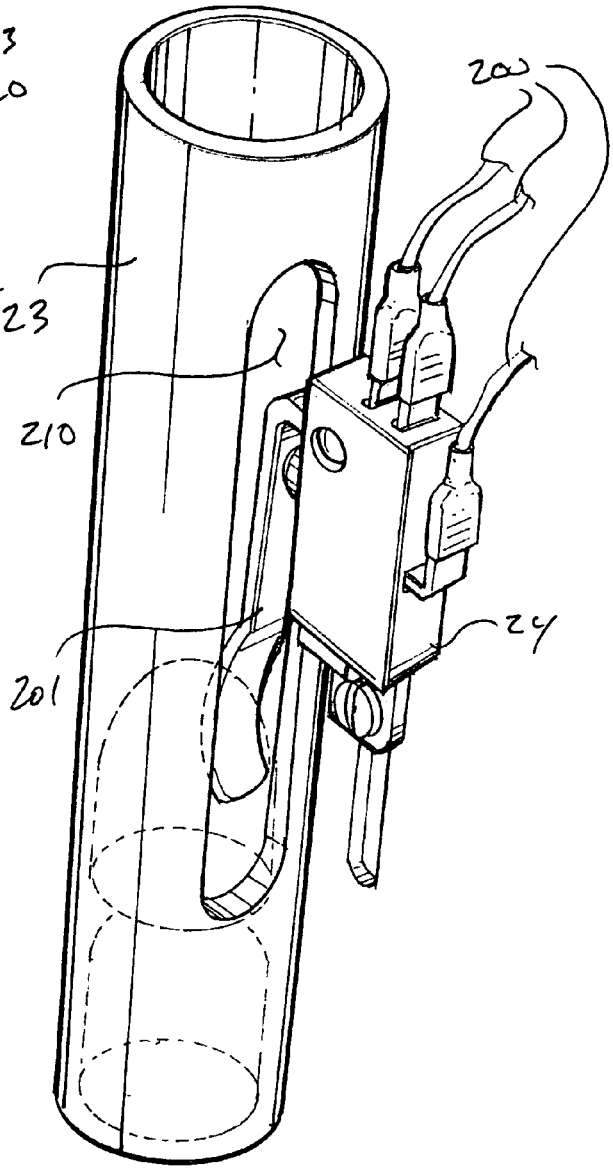
FIG. 9 is an enlarged perspective view of the switch illustrated in FIG. 8 shown associated with the bullet feed tube.

Rotary motor 51 and switch 24 are powered by a power source, such as a battery or a dedicated power source, such as a power cord plugged into an outlet. As previously mentioned in conjunction with FIG. 1, bullet feed tube 23 is operated by a switch 24. As seen in FIGS. 8 and 9, switch 24 is coupled to feed tube 23, and interacts with bullets 100 (FIG. 8) conveyed into tube 23 from rotary hopper 21 (not shown in FIGS. 8 and 9). The interaction of bullets in feed tube 23 operates switch 24.

Looking to FIGS. 8 and 9, switch 24 is coupled in signal and electrical communication to rotary motor 51 (FIG. 1) with conventional electrical interconnections 200. Toggle switch 24 incorporates a lever 201 movable between a produced position activating rotary motor 51 and a reduced or depressed position deactivating rotary motor 51. Switch 24 is a conventional spring-loaded toggle switch in which lever 201 is biased into its produced position activating rotary motor 51 causing rotary hopper 21 to convey bullets 100 to feed tube 23 through upper end 23A thereof. An elongate slot 210 is formed in feed tube 23. Lever 201 extends into feed tube 23 through slot 210.

Before utilizing bullet feeder apparatus 22 to seat bullets 100 into the open ends of shells 26 and with bullet feeder apparatus 22 at rest in the closed position of gate 122, rotary hopper 21 applies bullets 100 to feed tube 23, which forms a column of bullets 100 extending upwardly through feed tube 23 from bullet feeder apparatus 22. When the column of bullets reaches lever 201, the uppermost bullet 100 interacts with lever 201 extending into feed tube 23 moving lever 201 from its produced position to its depressed position deactivating rotary motor 51. At this point, use of bullet feeder apparatus 22 as herein previously described may commence.

As previously mentioned, bullets 100 each have a weight. Switch 24 is located along feed tube 23 at a predetermined location such that the combined weight of the bullets 100 forming the column resting atop the bullet to be loaded will apply a force against the bullet to be loaded that is sufficient to tamp the bullet to be loaded into the open end of a shell in the operation of bullet feeder apparatus 22, in accordance with the principle of the invention. If the weight of the column of bullets is either to small or too great, the bullet to be loaded will not be tamped properly, or otherwise tamped to a desired extent. During the operation of bullet feeder apparatus 22, switch 24 will activate rotary motor 51 of hopper 21 when the column of bullets falls below the influence of lever 201 causing it to spring into its produced position, and will deactivate rotary motor 51 of hopper when the column of bullets falls into the influence of lever 201 moving lever 201 into its depressed position. The location of lever 201 along feed tube 23 controls the length of the column of bullets 100. In this regard, switch 24 is positioned to locate lever 201 at a predetermined location for forming column of bullets 100 having a carefully predetermined weight that is sufficient to tamp the bullet to be loaded in the open end of the shell in a proper, recommended, or desired manner, in accordance with the principle of the invention.

In the immediate embodiment, switch 24 is mounted to a plate 220, which is in turn affixed to feed tube 23, in this instance with bands 221 although plate 220 may be affixed to tube 23 with other forms of clamps or mechanical fasteners such as rivets, screws, or the like. Switch 24 is mounted to plate 210 for movement in reciprocal directions relative to feed tube 23 as indicated by the double arrowed line B in FIG. 8 between raised and lowered positions relative to bullet feeder apparatus 22. In the instant embodiment, plate 220 is formed with an elongate slot 222 opposing slot 210 formed in feed tube 23, and switch 24 is mounted to plate 220 at elongate slot 221 with a conventional and well-known screw-operated clamp 223. Screw-operated clamp 223 may be loosened for allowing switch 24 to be moved in reciprocal directions along slot 222 relative to slot 210 of feed tube 23, and then tightened for securing switch 24 in place. The adjustability of switch 24 relative to feed tube 23 through the reciprocal adjustment of switch 24 between raised and lowered positions relative to bullet feeder apparatus 22 as generally indicated by double arrowed line B allows the weight of the column of bullets applied against the bullet to be loaded to be carefully controlled, i.e., increased and decreased, in accordance with the principle of the invention. Switch 24 may be mounted for movement in reciprocal directions in any suitable manner consistent with the teachings set forth herein without departing from the invention.

The interaction of bullets in feed tube 23 operates switch 24. In the immediate embodiment, the bullets interact with lever 201, in which case switch 24 is a lever-operated switch. Other switch forms can be used. If desired, lever-operated switch 24 can be replaced with an optical switch, a proximity switch, or other suitable non-contact sensing switch that non-contact senses the column of bullets 100 in lieu of a bullet contacting sensing of bullets as provided with lever 201.

§D. THE BULLET REJECTING APPARATUS

Figures 15, 16:
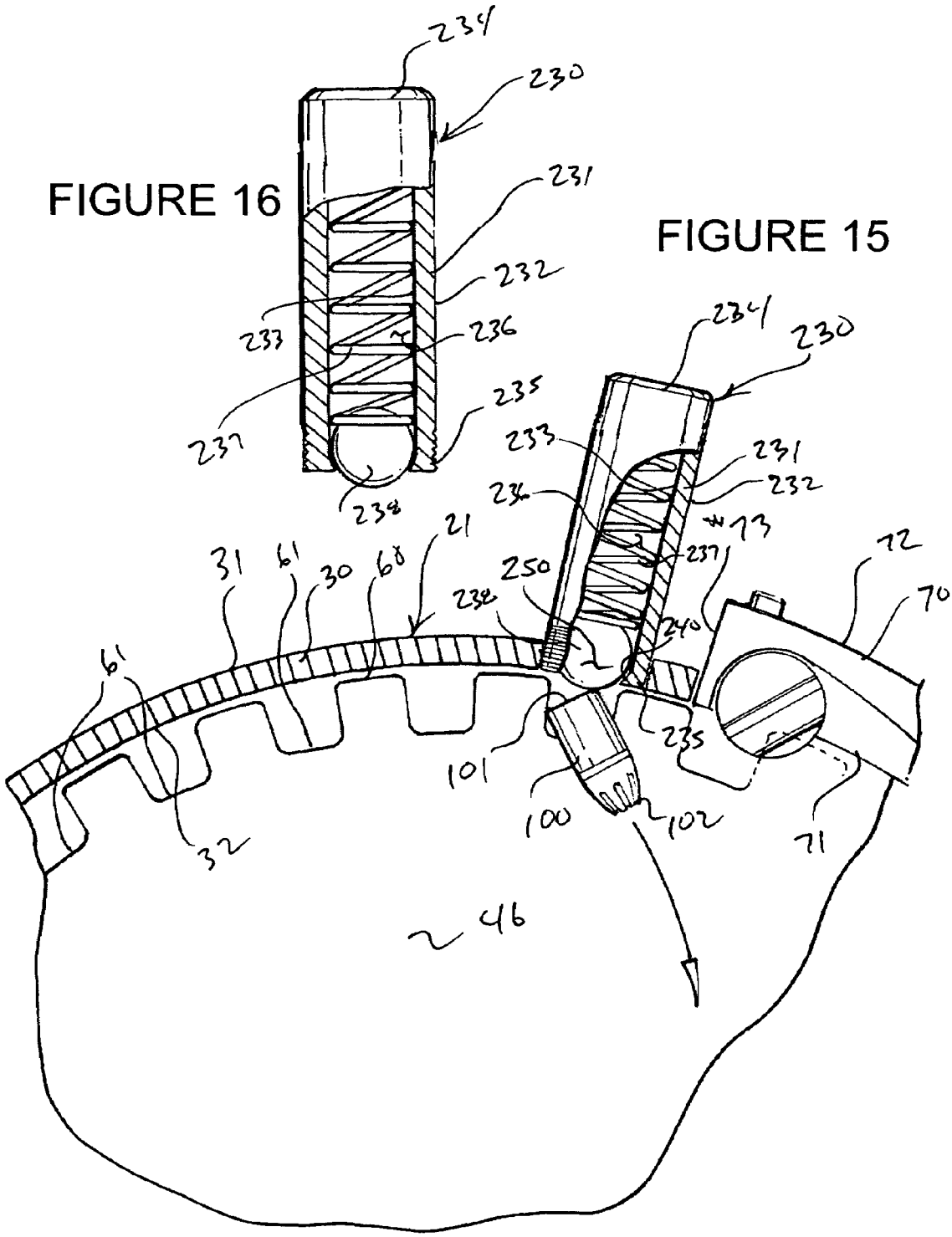
FIG. 15 is a fragmented top plan view of the of the rotary hopper of FIG. 1 shown as it would appear furnished with a bullet rejecting assembly.
FIG. 16 is a partial sectional view of the bullet rejecting assembly of FIG. 15.

Reference is now made to FIG. 15, in which there is seen a fragmented top plan view of rotary hopper 21 of FIG. 1 shown as it would appear furnished with a bullet rejecting assembly 230. Referring also to FIG. 16, bullet rejecting assembly 230 includes an elongate, continuous sidewall 231 having an outer surface 232, an inner surface 233, a closed outer end 234, and an opposed open inner end 235. Inner surface 233 defines a chamber 236 between outer and inner ends 234 and 235. A compression spring 237 and a ball 238 are disposed in chamber 236. Ball 238 is located at inner end 235, and inner surface 233 of continuous sidewall 231 at inner end 235 is inwardly tapered forming a seat 240, which prevents ball 238 from falling outwardly through inner end 235, yet allows ball 238 to present outwardly relative to inner end 235. Spring 237 is captured between outer end 234 and ball 238, and biases ball 238 against seat 240 such that ball 238 is biased outwardly relative to inner end 235. In this embodiment, spring 237 is a compression spring, although any suitable spring form capable of applying a bias against ball 238 can be used without departing from the invention.

Inner end 235 is applied to an opening 241 formed in continuous sidewall 30 of hopper 21, locating ball 238 at perimeter 60 of wheel 46 adjacent to, and just downstream of, upstream end 73 of block 70. As wheel 46 rotates conveying bullets 100 to block 70, bullets 100 only partially received in notches 61 will interact with ball 238 and be knocked away only to fall back into the population of bullets in hopper 21, in accordance with the principle of the invention. The bias applied to ball 238 by spring 237 keeps ball 238 in the proper position allowing it to knock away bullets 100 only partially received in notches 61, and yet provides ball 238 with compliance preventing ball 238 from pinching bullets 100 against wheel 46 which may otherwise damage wheel 46. If desired, spring 237 may be omitted and continuous sidewall 231 angled upwardly causing gravity to bias ball 238 against seat 240.

Figure 17:
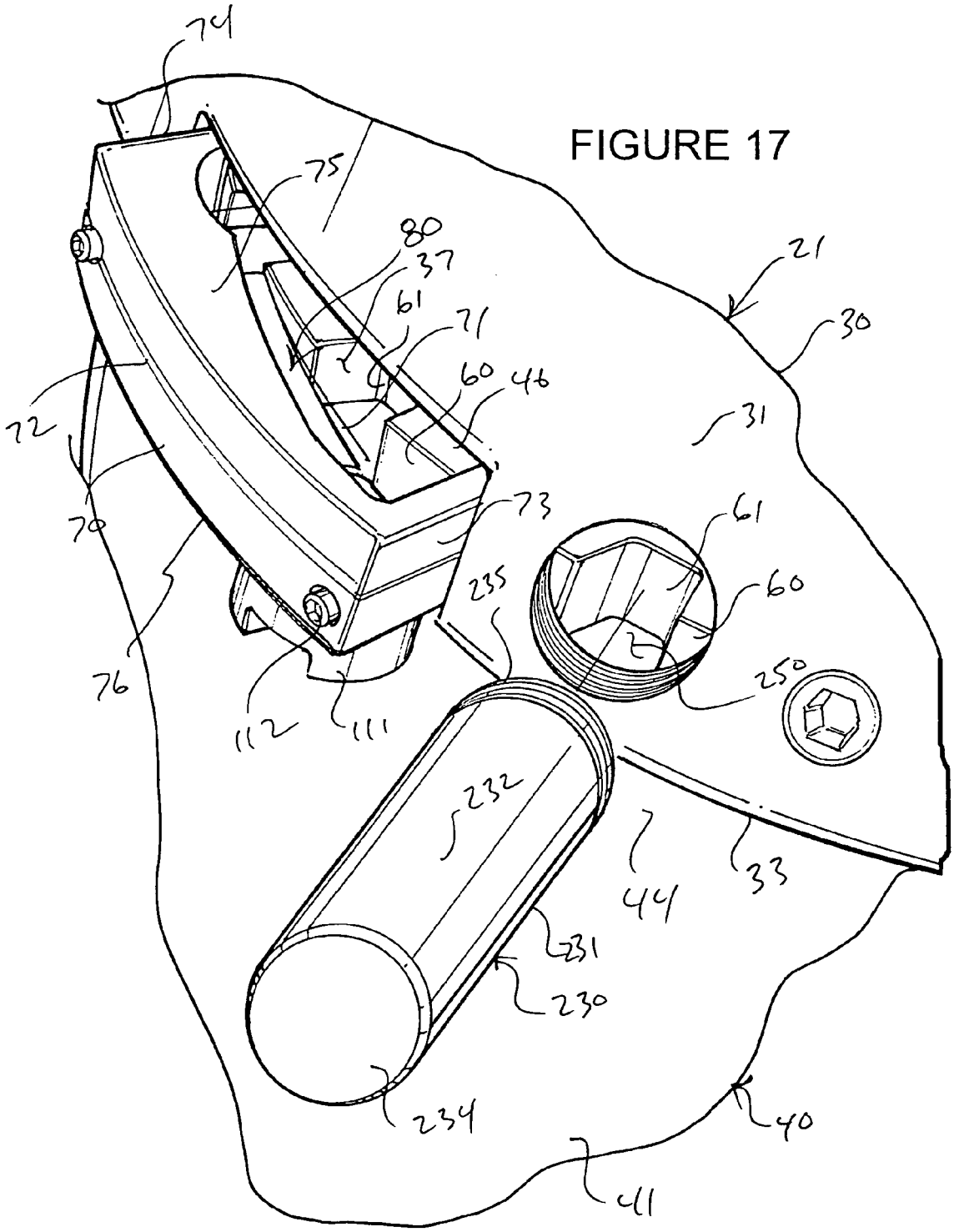
FIG. 17 is a perspective view of the bullet rejecting assembly shown as it would appear detached from the rotary hopper.

In this specific embodiment, outer surface 232 of continuous sidewall 231 is externally threaded at inner end 235, and is threadably applied to a corresponding threaded opening 250 formed in continuous sidewall 30 as illustrated in FIGS. 15 and 17. FIG. 17 shows assembly 230 as it would appear detached from hopper 21. Those having regard for the art will readily appreciate that other forms of engagement assemblies or pairs may be used to secure inner end 235 of continuous sidewall 231 of assembly 230 to continuous sidewall 30 of hopper 21 without departing from the invention. If desired, continuous sidewall 131 may be integrally formed with, or welded to, continuous sidewall 30 of hopper 21 and outer end 234 configured with a removable cap that may be installed thereon closing outer end 234 after installing ball 238 and spring 237 in chamber 236. In an embodiment in which spring 237 is omitted and continuous sidewall 231 is angled upwardly causing gravity to bias ball 238 against seat 240, continuous sidewall 131 may be integrally formed with, or welded to, continuous sidewall 30 of hopper and outer end 234 may be left open or fitted with a cap.

§E. CONCLUSION

A shell loading system 20 is disclosed, which incorporates rotary hopper 21 coupled to a bullet feeder apparatus 22 with bullet feed tube 23 fashioned with a switch 24 for interacting with bullets conveyed into tube 23 from rotary hopper 21 for operating rotary hopper 21. Hopper 21 incorporates bullet-orienting structure 80 which efficiently and inexpensively ensures bullets are feed into feed tube 23 in the proper tip end up orientation. Bullet feeder apparatus 22 speedily and efficiently tamps bullets into the open ends of shells, and is simple and easy to use unlike many of the more complicated and cumbersome bullet feeders prevalent in the prior art. The combination of rotary hopper 21 and bullet feeder apparatus 22 provides a fast and efficient system of loading bullets into shells, and solves many of the problems associated with current slow and cumbersome state of existing handloading systems. Other advantages and benefits of shell loading system 20 including hopper 21 and bullet feeder apparatus 22 will readily occur to the skilled artisan.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Bullet feeder apparatus for presenting a bullet in the open end of a shell, comprising:

a housing;

a fixture carried by the housing and bounding a bullet-conducting passage therethrough;

a gate mounted between the housing and the fixture for movement between a closed position closing the bullet-conducting passage preventing the bullet from passing therethrough, and an open position opening the bullet-conducting passage allowing the bullet to pass therethrough into the open end of the shell;

a bias applied to the gate biasing the gate into the closed position;

a deflector mounted between the housing and the fixture for movement between a first position comprising the deflector disposed away from the gate against a seat formed in the housing and the bias applied to the gate biases the gate in the closed position thereof closing the bullet-conducting passage, and a second position comprising the deflector disposed away from the seat against the gate overcoming the bias applied thereto deflecting the gate from the closed position thereof to the open position thereof opening the bullet-conducting passage; and an annular body disposed between the housing and the fixture encircling the fixture adjacent to the gate.

2. Bullet feeder apparatus according to claim 1, wherein the bias applied to the gate is supplied by a spring acting on the gate.

3. Bullet feeder apparatus according to claim 2, wherein the spring is coupled between the fixture and the gate.

4. Bullet feeder apparatus according to claim 1, further comprising:

an opening formed in the fixture leading to the bullet-conducting passage; and the gate mounted for movement through the opening between the closed and open positions thereof.

5. Bullet feeder apparatus according to claim 1, whereby in the closed position the gate is located in the bullet-conducting passage preventing the bullet from passing therethrough, and in the open position the gate is located away from the bullet-conducting passage allowing the bullet to pass therethrough into the open end of the shell.

6. Bullet feeder apparatus for presenting a bullet in the open end of a shell, comprising:

a fixture bounding a bullet-conducting passage therethrough;

a bullet feed tube coupled to the bullet-conducting passage;

a gate mounted to the fixture for movement between a first position in the bullet-conducting passage, and a second position away from the bullet-conducting passage;

a bias applied to the gate biasing the gate in the first position thereof;

the gate disposed in the first position;

a bullet to be loaded located in the bullet-conducting passage and positioned on the gate;

a column of bullets in the bullet feed tube, the column of bullets resting atop the bullet to be loaded via a lowermost bullet of the column of bullets, and the column of bullets defining a weight applied against the bullet to be loaded;

a deflector mounted proximate the fixture for movement between a first position comprising the deflector disposed away from the gate in the first position thereof, and a second position comprising the deflector disposed toward and against the gate overcoming the bias applied thereto deflecting the gate from the closed position thereof to the open position thereof opening the bullet-conducting passage;

in response to movement of the deflector from the first position to the second position moving the gate from the closed position to the open position the column of bullets and the bullet to be loaded together displace toward the open end of the shell in which the bullet to be loaded passes into the open end of the shell from the bullet-conducting passage, and the weight of the column of bullets applied against the bullet to be loaded via the lowermost bullet of the column of bullets applies a tamping force against the bullet to be loaded positioned into the open end of the shell to tamp the bullet to be loaded into the open end of the shell to form a tamping union between the bullet to be loaded and the open end of the shell; and after the tamping union between the bullet to be loaded and the open position of the shell, in response to movement of the deflector from the second position to the first position moving the gate from the open position to the closed position the gate interacts with the lowermost bullet of the column of bullets to retain the column of bullets in the bullet-conducting passage.

7. Bullet feeder apparatus according to claim 6, wherein the bias applied to the gate is supplied by a spring acting on the gate.

8. Bullet feeder apparatus according to claim 7, wherein the spring is coupled between the fixture and the gate.

9. Bullet feeder apparatus according to claim 6, wherein the deflector comprises an annular body encircling the fixture adjacent to the gate.

10. Bullet feeder apparatus according to claim 6, further comprising:

an opening formed in the fixture leading to the bullet-conducting passage; and the gate mounted for movement through the opening between the closed and open positions thereof.

11. Bullet feeder apparatus according to claim 6, further comprising:

a seat opposing the fixture; and the deflector located against the seat in the first position thereof.

12. Bullet feeder apparatus according to claim 11, wherein the seat is formed in a housing maintaining the fixture.

* * * * *